United States Patent [19]

Andrews

[11] 4,005,334

[45] Jan. 25, 1977

[54] ELECTRIC INCANDESCENT LAMP COMBINATION FIXTURE DEVICE

[76] Inventor: Peter Andrews, 190 Gebhardt Road, Penfield, N.Y. 14526

[22] Filed: Feb. 12, 1974

[21] Appl. No.: 442,082

Related U.S. Application Data

[63] Continuation-in-part of Ser. No. 240,605, April 3, 1972, abandoned, which is a continuation-in-part of Ser. No. 25,994, April 6, 1970, abandoned.

[52] U.S. Cl. ..... 315/208; 200/298; 315/71; 315/200 R

[51] Int. Cl.[2] ..... H05B 37/00

[58] Field of Search ..... 315/71, 200 R, 205, 315/DIG.4, DIG. 7, 208; 200/298, 299

[56] References Cited

UNITED STATES PATENTS

| | | | |
|---|---|---|---|
| 3,028,525 | 4/1962 | Morton | 315/71 X |
| 3,215,891 | 11/1965 | Fritz et al. | 315/200 R X |
| 3,416,028 | 12/1968 | Levin | 315/71 X |
| 3,530,501 | 9/1970 | Benschoten | 315/200 R X |
| 3,748,532 | 7/1974 | Rosenbaum | 315/DIG. 7 |

*Primary Examiner*—R. V. Rolinec
*Assistant Examiner*—Lawrence J. Dahl

[57] ABSTRACT

An electric incandescent lamp dimming combination fixture device having a subcombination which has at least one thyristor type of semiconductor component, with or without a voltage transient protecting "G.E. MOV." type VP varistor, as desired, and with or without a separate selective electric switch or switching means. The combination fixture device having, in at least one of its other embodiments, a subcombination of at least one-half-wave diode rectifier or rectifying means which is an semiconductor member, of the silicon type, with or without a varistor of the zink oxide doped with gallium oxide diode type, or even a diode of the germanium type, as desired, and at least one electrical selectively switching means. At least one of the above subcombinations, for example, being electrically connected in the electrical circuit of substantially at least one portion of the fixture portion of the fixture device so that variable dimming of at least one incandescent lamp and/or at least an "on" full illumination and/or substantially a "half-on" or "half-wave" diode electrical dimming, of at least one incandescent lamp or bulb of and at a hung type of incandescent lamp fixture device dimming combination may be provided as desired. The first and second mentioned subcombinations also providing new and improved utility, by having at least one of the subcombination means electrically connected in the electrical circuit of the electric fixture device between, for example, the source of electric current supply and at least one electric contact member of an electric socket member of an electric incandescent lamp or bulb, or even between the source of an electric current and a, for example, 1, 2 or 3-way electric selective switch or switching means which passes electric current substantially to at least one 1-way, at least two 1-way, or even at least one 3-way incandescent lamp or lamps of the combination fixture device.

21 Claims, 38 Drawing Figures

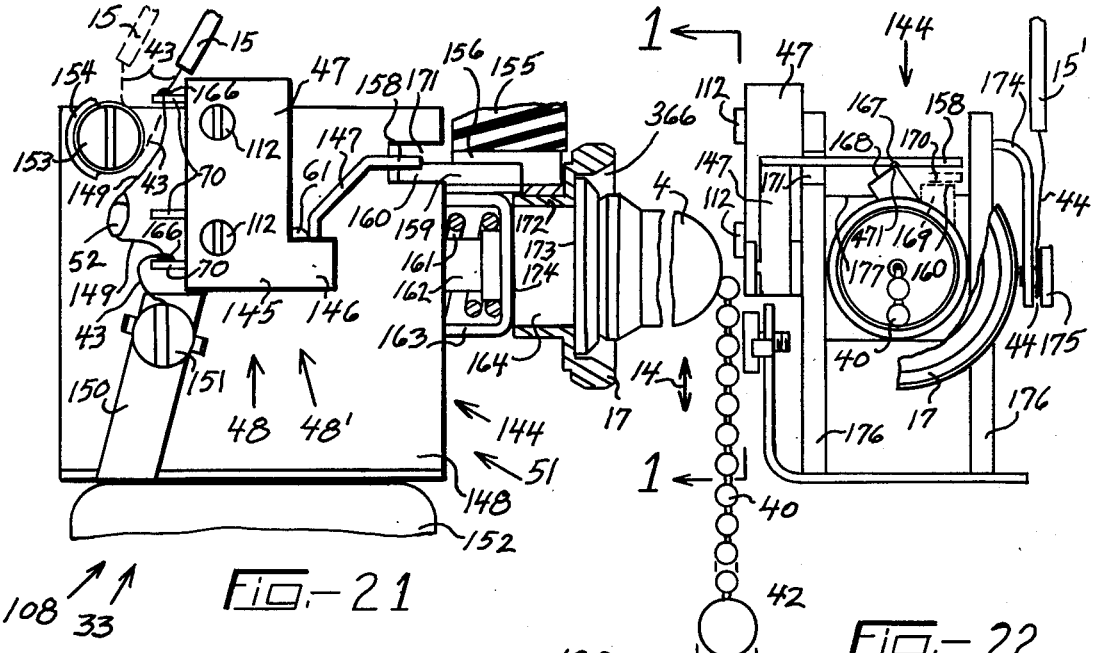
Fig.-21
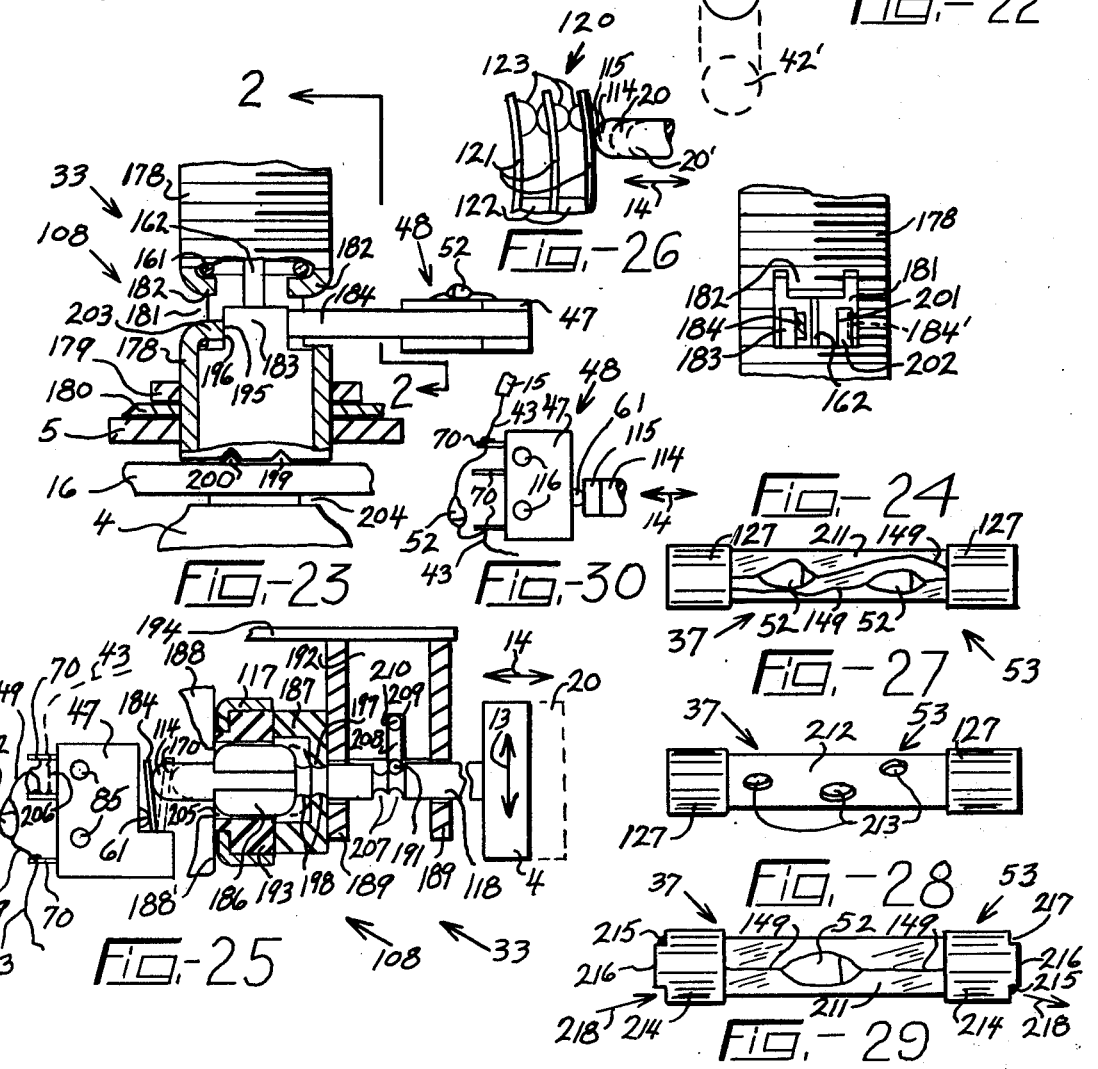
Fig.-22
Fig.-23
Fig.-24
Fig.-25
Fig.-26
Fig.-27
Fig.-28
Fig.-29
Fig.-30

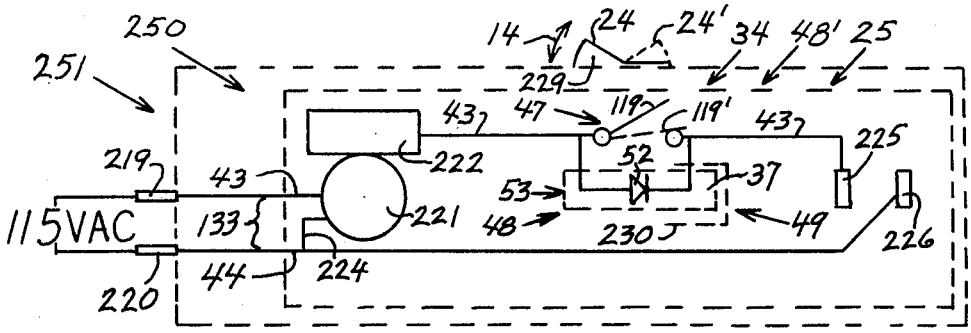
Fig.-31
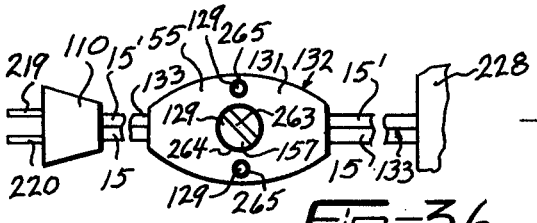
Fig.-36
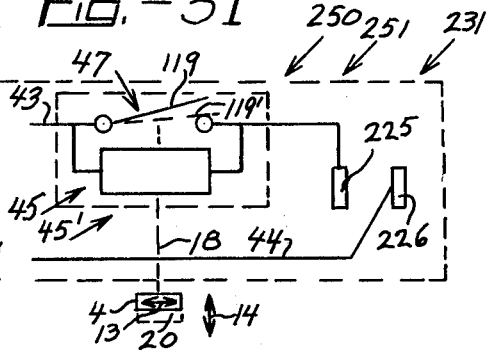
Fig.-32
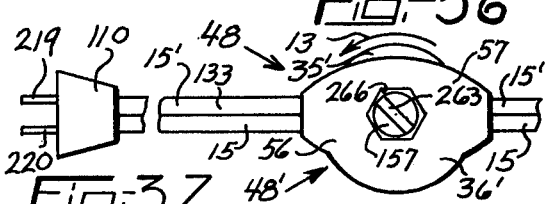
Fig.-37
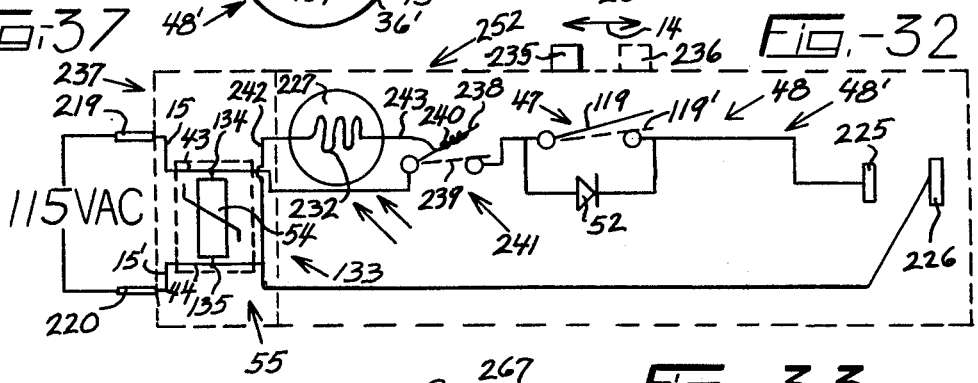
Fig.-33
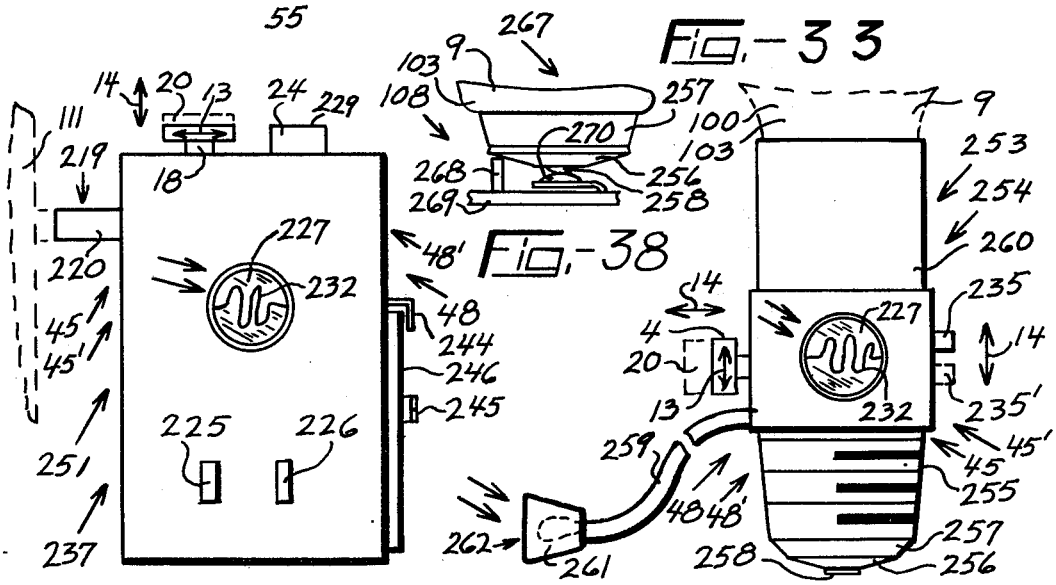
Fig.-38
Fig.-34
Fig.-35

ELECTRIC INCANDESCENT LAMP COMBINATION FIXTURE DEVICE

This application is a continuation-in-part of my copending application Ser. No. 240,605 filed Apr. 3, 1972, now abandoned, which was a continuation-in-part of my copending application Ser. No. 25,994 filed Apr. 6, 1970, abandoned.

BACKGROUND OF THE INVENTION

This invention relates primarily to hung incandescent lamp dimming and non-dimming combination fixture devices and switches. Incandescent lamp dimming devices of various types having various electrical circuits and constructions are well known in the art. Six, state of the art, of many known prior art references, for example, are being cited herebelow accordingly, for providing a full or better understanding of the prior art, and this invention or at the time that at least one of several disclosed inventions, as a whole, was made.

J. B. Rickey — U.S. Pat. No. 3,518,602 — Issued June 30, 1970.

S. C. Peek, Jr. — U.S. Pat. No. 3,379,861 — Issued Apr. 23, 1968.

E. Seid — U.S. Pat. No. 3,028,523 — Issued Apr. 3, 1962

W. H. Fritz et al — U.S. Pat. No. 3,062,986 — Issued Nov. 6, 1962.

R. C. Morton — U.S. Pat. No. 2,896,125 — Issued July 21, 1959.

C. E. Felch — U.S. Pat. No. 596,582 — Issued Jan. 4, 1898.

The 1970 Rickey device being the most common type of incandescent lamp dimmer in use today, is a variable incandescent lamp dimmer unit which is generally mounted into a wall electrical outlet box, and further which unit is mounted in the removable lamp plug adapter, and being inserted into a lamp socket receptacle, and thereby being located after, in that it is located between a single pole single throw or a single position electrical "on" switch and the filament of an incandescent lamp. Rickey's dimmer device is thereby generally uneconomical or impractical for use with a multiple, for example, four position electrical 3-way lamp socket switching means because at least one electrical switching position being thereby always wasted. In essence, it is like putting "the cart before the horse" drawback or disadvantage.

The 1968 Peek device being a commutator type of electrical resistor which is inserted into a removable lamp plug adapter, and regarding the conventional four position disclosed lamp socket switching means, it is only useful generally as in Rickey's device, but in Peek at least two electrical switching positions are always wasted.

The 1962 Seid 3-way lamp socket, silicon diode rectifying adapter is generally the same invention as that of the following Fritz device and is owned or assigned to the same company as is the Morton diode dimming device, hereafter also disclosed.

The 1962 Fritz, being a silicon rectifier or rectifying lamp dimming device or unit which is freely dropped into a lamp socket receptacle portion having two electrical contacts of a conventional four position 3-way incandescent lamp switching means therein. Then the base of a conventional single element lamp 10 is inserted into the receptacle portion of the socket for electrical contact with the dimmer device's center electrical contacting portion, to thereby provide an off, bright, dim and the same first position bright illuminating position, in one revolution of the conventional ratchet type of four position lamp socket's switching means, and thereby repeating one electrical illuminating position with use of the conventional four position switch. Thereby, electricity is always wasted, as well as one switching position, and being the only use and combination of illuminations possible, thus providing the utility, as stated, for a single element lamp only and thereby also at least wasting money because of the second bright illuminating switching position for each single revolution of the switch, and when only one filament is desired to be illuminated and then switching the switch of the 3-way lamp socket switching means to its "off" position.

1959 Morton device also shows a half-wave diode rectifying means for a single element lamp and having the rectifying means in combination with a wall mounted switch, making it impossible to dim one lamp of a two, three or four lamp fixture means, or a chandelier, or even any lamp in a hung type of electrical fixture which is electrically connected directly to a conventional 24 volt relay means from the wall position. Morton also having a rectifying means electrically connected between a selectively switching means and a lamp inserted in a lamp socket as shown in FIG. 3 of Morton's drawing. Here again is the disadvantage, as is generally in all the prior art, whereby here again "the cart is put before the horse" and especially, for example, when a conventional 3-way switching means is present in the fixture or lamp socket means whereby the lamps full 3-way utility is not recognized or suggested, as in the objects disclosed hereafter.

The, generally 76 years old, 1898 Felch lamp dimming combination device being in the form of a hung type of lamp socket having an electrical heat producing and an electrical wasting resistance medium therein. The medium is manually rotated and elevated by a knob member located on the outside of the lamp socket housing, when a lamp is thereby desired to be dimmed.

OBJECTS OF THE INVENTION

An object of my invention is to provide a hung electric current incandescent lamp combination fixture device which is supportingly suspended from at least one portion of, for example, a ceiling and/or a wall and having at least one subcombination comprising of at least one electrical selectively switching means and at least one semiconductor half-wave diode rectifying means of the nonohmic type, for simply, economically and efficiently controlling, at the fixture, at least a shunted electrical "on" or unrectified full illumination and a non-shunted half-wave diode rectified or "half-on" dimmed illumination of at least one incandescent lamp or bulb of the fixture. The dimmed illumination is otherwise impossible to be performed from a wall portion of a room, for example, when at least one electrical wire or electrical conductor means of the fixture is electrically connected directly to a conventional 24 volt electrical relay switching means, which is conventionally used for electrically switching a 115 volt electrical current source of supply "on" and "off" to the connected electrical conductor means. The relay switching means being used for passing the 115 volt supply of electrical current substantially to said subcombination when an electrical momentary contact switching means generally at a wall location is actuated into its "on" and "off" position. The switching by-passing "on" illumination and the direct "half-on" illumination of at least two; three; four; five; six or all the lamps in the fixture being thereby controlled at the fixture by actuating the switch or switching means of the subcombination.

Another object of my invention, taken with a portion of the above object, is to provide at least one of the fixtures with the subcombination wherein the selectively switching means has at least three switching positions of an "off" and two other positions for passing electrical current through the rectifying means resulting in a substantially "half-on" or dimmed lamp effect and a by-passing or non-rectified "on" electrical current to at least one, at least two or to all of the lamps of the combination fixture. The above switching being made at the fixture even when there is or is not an electrical switching relay electrically connected ahead of the subcombination for controlling the electrical current supply of an "on" and "off" to the subcombination, and especially when the expensive relay malfunctions into a closed electrical position.

A still another object of my invention is that by having the subcombinaton of the electrical selectively switching means and at least one half-wave diode rectifying means electrically connected ahead of, in that the subcombination is connected between the electrical current supply and a conventional and even a non-conventional multiple electric selectively switching means directly to at least one lamp in an electric fixture, and being fpr example, a 2-way and/or 3-way selectively switching means, for providing, at the fixture device, at least 4 and/or at least 6 separate levels of brightness or illumination from at least one, for example, 2-way or 3-way incandescent lamp or bulb.

A still another object of my invention is to provide an electrical switching, rectifier or rectifying means by-passing, position for of at least one incandescent lamp of a fixture, in event there is a malfunction of a variable or even a half-wave rectifying means.

Another object of one of the embodiments of my invention is having, in the fixture's electrical circuit, a multiple electrical selectively switching means in electrical connected combination with at least one subcombination of at least one electrical selectively switching means and at least one half-wave diode rectifying means, whereby at least one set, for example, of 3 separate lamps or at least one 3-way lamp, for example, of the 30, 70 and 100 watt type, can be electrically illuminated into at least 7 and 8 different, groups of 3, combinations of light intensities or lamp illuminations of, for example, (1) low, medium and high; (2) rectified half-low, half-medium and half-high; (3) rectified half-low, rectified half-medium and high; (4) rectified half-low, rectified half-medium and high (5) low, medium and half-high; (6) low, medium and rectified half-high; (7) low, rectified half-medium, and high; (8) rectified half-low, medium and rectified half-high; accordingly, as desired, with each group additionally having the conventional "off" electrical switching position by either using the same or even by using a separate selectively "on" and "off" electrical switching means, as desired.

Another further object of my invention, having the immediately above mentioned subcombination electrically connected ahead of a conventional multiple switching means therein, is to provide at least one new and improved multiple selectively switching means being a combination in the lamp socket portion of the fixture whereby the actuation of only one switch knob is required for an "off"; rectified "half-on"; and a non-rectified "on" electrical switching position, for example, for at least one single filament incandescent lamp or so that an "off" and six separate levels of illumination for at least one 3-way lamp, and further at least one or all of the previously disclosed six separate levels of illumination or even at least one or all of the previously disclosed eight different groups of three combinations of illumination are thereby obtainable, as desired, in a facile, economical and very efficient way.

A further object of my invention, having the above object in mind, is to provide a new and improved multiple switching combination means, in the lamp socket portion of the fixture, whereby manual actuation of two separate switch members is necessary to at least provide all of the "off"; "half-on"; and "on" as well as the six levels of illumination or even the eight different groups of three combinations of illuminations, in a still another facile, economical and very efficient way and yet save electricity and provide larger lamp life.

And another object of my invention is to provide new and improved combinations being an electrical cord switching means in electrically connected combination with at least one half-wave diode rectifying means, whereby one combination embodiment of the cord switching means having only a "half-on" and an "on" electrical switching positions, with no electrical "off" position and another embodiment of the cord switching means having at least one, open or the "off" and a diode rectifying means of "half-on" and an "on" electrical switching positions for at least one single element lamp incandescent or lamps, and for also providing any desired one or any portion or all of the previously hereabove disclosed six or eight different groups of three, combinations of illuminations, when using a conventional 3-way lamp, for example, and a conventional 3-way lamp socket having electrical selectively switching means.

A yet another object of my invention is to provide a new and improved combination of a multiple position electric selectively switching means for at least one portion of an incandescent lamp fixture so that, as a whole, less electrical generated power is required by a generator means, and especially when at least one incandescent lamp is at least half-wave dimmed by the use of a very cheap and simple half-wave diode rectifying semi-conductor means, whereby, for example, generally 50 percent of electricity is saved. And further at least saving of, for example, the 50 percent of electricity that is obtained in one direct, positive and simple manual switching operation over that of a variable "SCR" incandescent lamp dimming means. Also, lamp and filament life is substantially extended and prevention of aggravation to a person is thereby efficiently and readily obtained, and in a facile new and improved way by having one portion of the switching means always remained in an electrical "on" position while a separate switching means or even another portion of the switching means is switched into an electrical "off" or an "on" position as desired, or is switched into an electrical "off"; "half-on" diode rectified; and "on" position, as desired.

A yet another object of my invention is to have at least two silicon diode rectifying means connected in series, alone or in a buss-fuse-type cartridge and thereby should one of the rectifiers malfunction, then the other rectifier will still be able to dim at least one incandescent lamp, and it is also desired to have at least two of the silicon rectifying means connected in parallel when space is limited, or when more electric current carrying capacity (amperage), is required for reducing the maintenance and/or for reduction of the physical size of the new and improved fuse-like diode cartridge invention.

A still another object of my invention is to provide, at least one of the fixtures, with at least one new and improved lamp socket electrical selectively switching means having the subcombination comprising of the electrical selectively switching and at least one "half-wave" diode rectifying means. The subcombination is electrically connected ahead of a multiple switching means and is also substantially housed in the lamp socket for simply, economically and efficiently selectively illuminating at least one incandescent lamp, having at least two filaments, into a 4-way lamp, thereby having one "off" and 2 "on" and 2 "half-on" and/or even into a 6-way lamp having 3 "on" and 3 "half-on" illuminating conditions, and/or even into one or any or all of the previously disclosed 8 separate, groups of 3, combinations of illuminations, as selectively desired.

And another object of my invention, having at least the previous object in mind and the fixture having an "off" and "on" electrical switching means, is to provide a new or even an improved miniature and non-miniature, electrical cord selectively switching means having the subcombination therein, which subcombination having no electrical "off" but only an "on" and a rectified "half-on" electrical switching position for at least simply, economically and efficiently controlling the "half-on" or dimmed illumination of at least one incandescent lamp, in the fixture. And when the fixture has a separate selectively "off" and "on" electrical cord switching means or even a switching means having an "off" and at least 3-positions of "on", then any one or all the 8 groups of 3, combinations of illuminations are also still possible, by use of a 3-way lamp socket having a 3-way lamp therein or even at least 3-separate single-element lamps of 50, 75 and 100 watts, for example.

A further object of my invention is to provide a new and improved electrical, cord, selectively multiple position switching means for providing at least one electrical "off", "half-on" and "on", selectively, switching positions for at least controlling the "half-on" and "on" illumination and the "off" electrical condition of at least one inserted incandescent lamp of the fixture, especially when a swag chain, table, and the like type of the fixture, having electrical cord plug-in means and possibly having no other switching means or a switching means which is not desired to be used or having a switching means which is difficult or inconvenient to reach.

A still another further object of my invention, taken with the previous two objects, is that the improved electrical cord selectively switching means, have at least one-half wave diode rectifying means therein and be of the electrical cord feed through and/or of the pendant electrical cord type, as desired, and each type accordingly having at least two separate embodiments of at least two or even at least three electrical selectively switching positions, and as desired, also be combined with electric cordsets having male and female, plug and conductor means.

A yet another object of my invention is to provide an electric incandescent lamp fixture with a new and improved electrical switching combination means having one portion thereof as a multiple selectively switching means having only a switching electrical "on" position and thereby having no electrical "off" position. The combination switch may be substantially housed in the lamp socket or other portion of the fixture, for example, and having another portion of the combination as a two-position second electrical "off" and "on" or an "off"; "half-on" and an "on" three-position second selectively switching means which may, for example, be in the same socket or another portion of the fixture. The switching means may be of the slide, lever, rotary, illuminated or not illuminated, numbered or unnumbered, and the like type, so that a person will not be aggravated and/or be forced to waste money by wasting electricity and/or also creating a premature burn-out of at least one, two or three, or even all of the single element lamps of a fixture, and/or accordingly at least one filament or even both filaments of a 3-way lamp. Thereby each time it is desired to illuminate only the first lamp of a, for example, 3-lamp fixture having a one-way conventional multiple 3 or 4-way switching means or each time only the first filament of a 3-way lamp is desired to be illuminated, for example, a person must thereby always switch electrical current through the other filament and then through both filaments or even through all other lamps or filaments when it is desired to actuate the one-way ratched type of switch, for example, into its electrical "off" position.

Another object of my invention, taken with the above object, is that each time a person desires, for example, to illuminate a particular lamp or lamps or a particular single filament lamp or even, for example, a 50 watt filament of a 50, 100 and 150 watt 3-way lamp, and then desires to switch the new and improved multiple switching combination means, and, of course even at least one 3-way lamp, into its "off" electrical position, whereby the preselected electrical "on" switching position for the 50 watt illuminating portion of the 3-way lamp is not disturbed.

And thereby, the 50, 100 or 150 watt switching position may be preselected before any electric current is switched "on" by use of the previously disclosed two-position or even a three-position second switch or even a second selectively switching means.

And another object of my invention taken as desired with the above object, is to provide at least one portion of the fixture of a floor; table; pole; bed; swag-chain; wall mounted; ceiling and/or wall supported; nite-lites; clock timers for lamps and appliances, string of Christmas tree lites or lamps and the like, having an insulated electrical cord means, with an electric cord multiple switching means having, for example, three selectively switching positions of, for example, an electrical "off", "on" and "half-on" diode rectified or an electrical "off", "half-on" diode rectified and an "on." The switch or electric switching means may also have a half-wave diode rectified "off" and "on" only or even have only an "on", a non-rectified electrical "on" and "half-on" diode rectified switching means, as deemed necessary or as desired, and even when there is or is not a non-multiple electrical or single switching means having an "off" or no "off" or an "off" and an "on" electrical positions, accordingly. Thereby one or even any of the previously disclosed 4, 6 or the 8 separate groups of 3 illuminated combinations may be obtained in the new and improved and in a more facile, economical and efficient way.

A yet still another object of my invention, taken further with at least one of the latter 3 objects, is to provide, for example, a push-button electrical switching means as on a conventional fan or liquid blender means, 3, 4, 5 and even 6 separate electrical switching means whereby a first electrically connected selectively switching means being an electrically connected switching combination or subcombination means having at least one half-wave diode rectifying means electrically connected therein so that at least one of its electrical switching full-wave "on" positions may be substantially half-wave rectified into a "half-on" or "dim" electrical state at any desired time and thereby at least 2, 3, 4, 5 and even 6 separate incandescent lamps or at least one 3-way incandescent lamp may be selectively switched "off" or even be electrically switched into one or any and all of the 6 "half-on" or an "on" illuminated conditions as well as the 8 separate groups of 3 combinations, as desired. Specific switching identification as well as specific filament, filaments, lamp or lamps may also be specifically identified by illuminating at least one miniature incandescent lamp or a neon lamp or a solid state lamp (light emitting diode) and the like means. Also the use of switch push-button position numbering means may be employed, as desired. Various combinations of incandescent lamp filament combinations being readily obtained as, for example, a "half-on" or an "on" illumination or brightness of say a 50 or 100 watts; 50, 100 or 150 watts; 100, 50 or 150 watts, 150, 100 or 50 watts; 50, 150 or 100 watts and the like in a more facile, economical and improved way.

A yet another object of my invention is to provide a thyristor type of variable incandescent lamp dimming means as disclosed in my copending Ser. No. 240,605 and Ser. No. 25,994 applications and/or a half-wave rectifier cord switching means for use on Christmas tree lamps for varying the light intensity of the incandescent lamps which, when dimmed, have a longer life; the lamps are not as hot; electric current is saved; drying out of the Christmas tree and/or needles is prolonged by having less lamp heat; large lamps may be used with artificial trees without scorching the artificial needles of the tree, especially since tree manufacturers caution against use of large lamps and to use only miniature lamps; and a very restful dimmed indoor at least Christmas tree lighting effect is obtained, even with use of miniature Christmas tree lamps, and even outdoor post lamps, Christmas tree and other ornamental colored incandescent lamp effect is thereby achieved, in an improved facile, economical and efficient way.

A yet still further object of may combination invention is to use a thyristor type of incandescent lamp dimming means in connected electrical combination with a second thyristor variable incandescent lamp dimming means which is mounted in a wall portion of a room or hall so that at least one dimmed incandescent lamp of at least one fixture may be further dimmed beyond that of the variable, wall mounted, dimming means by cutting the second, lamp fixture mounted, variable dimming means into the already rectified electrical circuit, whereby at least one lamp of at least one fixture device may be further illuminated and then be redimmed or even further redimmed, as in a restaurant after reading a menu for example, as desired accordingly.

A yet further object of may invention, taken with at least one of the previous objects, is to provide greater efficiency; prevent lost manual motion and aggravation; save at least 40% of electricity and thereby money; prevent at least one premature filament or incandescent lamp burn-out; greatly extend the life of at least one filament or lamp and the like by providing, for example, a rotary selectively switching means having a shaft member which is rotated in a clockwise or a counter-clockwise switching direction and additionally having the same shaft axially or axially and detentably movable for selectively switching electrical current into an "off" and "on" or an "off", "half-on" (diode rectified) and "on" preselected state, to at least one of the previously disclosed filaments or lamps, as desired, and even by the use of a SCR, thyristor semiconductor variable dimmer means to one or even 2 separate filaments of at least one lamp means. For example, the "Triac" type of Silicon Controlled Rectifier (SCR) means as disclosed in my copending applications Ser. No. 240,605 filed Apr. 3, 1972 and Ser. No. 25,994 filed Apr. 6, 1970.

Another still yet further object of my invention, taken with or without at least one of the previous objects, is to provide an "on" or "half-on" electrical current or illumination to at least one filament or at least one incandescent lamp by axially and rotatingly moving the shaft member, of a selectively switching means, which shaft member is also rotatingly moved for at least making an electrical switching connection to at least one filament in a 3-way lamp or to at least two separate 3-way lamps, or to at least three single filament lamps as desired.

A yet further object of my invention, taken with at least one portion of at least one of the previous objects, is to combine a conventional multiple switching means of a lamp socket means or a separate selectively multiple switching means with at least one of the previously disclosed subcombinations having the switching and half-wave rectifying means, whereby both or either a rotary and/or an axial movement of two separate switching shaft portions of a dual multiple switching means is constructed for illuminating only at least one, two, three and even up to say 10 alternating electric current incandescent lamps, of the fixture, in any desired "on" and/or rectified "half-on" illuminations.

And a yet further object of my invention taken alone or with at least one of the previous objects is to provide a buss-diode rectifying cartridge means for saving money, time and possibly the fixture itself by having at least one "half-wave" diode rectifying means housed alone, in series or in parallel, within the substantially tubular buss fuse cartridge of the one time or the renewable type for replaceably inserting the "buss-diode rectifying device" into the electrical circuit of at least one portion of the fixture, whenever the rectifying means in the cartridge malfunctions.

A still further object of my invention is to have at least one electrical selectively switching by-passing diode means in associated combination with at least one, half-wave, diode rectifying means which is electrically connected singularly or in parallel or in series arrangement, especially when there is a given limited space in a conventional switch housing, casing or within the conventional buss-fuse cartridge, so that efficient and economical insertion and/or changing of the rectifying means, which is preferred to be a matched pair, so that at least the passage of more amperes of electric current is substantially passed through the rectifying means and then to at least one incandescent lamp means.

Another object of may invention is to enable a person to replace at least one half-wave, semiconductor, diode rectifier means as conveniently and efficiently as is the replacement of a buss-fuse cartridge for example, especially when the diode rectifying means (within the cartridge) has malfunctioned into an open or closed electrical state or condition, and further objectively by providing buss-fuse clips or a panel mounted and/or in line type of buss fuse holder means and the like for the now one time or reusable, "diode rectifying fuse-like cartridge subcombination device."

Another important object of my invention, with the above object in mind, and having at least one of the half-wave diode rectifying means housed in the buss-like cartridge device, is to overcome the great disadvantage and cost associated therewith when the otherwise hard to get to mechanically connected or soldered in place, rectifying means malfunctions and thereby forcing a person to repair substantially the dimmer unit or replace it, possibly along with the electric switching means associated therewith, and further possibly discarding the entire fixture depending on its cost, design or the person's fancy and/or wealth accordingly.

And another object of my invention, is to provide an electrical plug-in adapter; and electrical cord connector; an electrical plug-in receptable; an electrical cord plug-in plug; an electrical cord switching and non-switching pendent plug; and an electrical receptable in at least one embodiment thereof, with the subcombination of the electric two-position switching and diode rectifying means, and in another embodiment thereof with the above subcombination taken with a conventional electrical "off" and "on" selectively switching means for thereby controlling the illumination of at least one incandescent lamp, that is inserted in an electric cord lamp socket means; in at least one portion of at least one fixture device; or in a string of Christmas tree lamp socket means; or in at least one outdoor Christmas or ornamental lamp socket means, as desired.

And still another object of my invention, taken with at least one of the previous objects is to electrically combine, with at least one conventional "off" and "on" pull chain selectively switching means or even a multiple 3-way or a four-position pull chain switching means, with at least one new and improved "on" and "half-on" cord; band; slide; rocker; leaf; push button; toggle, cherry; micro; lever; rotary; push-push; push-pull; pull-push; levolier type of pull chain and non-pull chain; pull-chain and the like subcombination type of switching and rectifying means for illuminating at least one lamp of the fixture device into a "half-on" and an "on" or even by use of, for example, a canopy, levolier and the like type of single way even a or 3-way, 4 position selectively switching means, whereby at least one lamp in the fixture device and/or the disclosed 8 separate, groups of 3; and the other disclosed lamp illuminations are thereby made possible, as desired, especially when the lamp socket's or other switching means of the fixture is difficult to reach by hand or is generally impossible to be directly reached, without dismantling a portion of the fixture.

A still another object of my invention, taken partially with the preceding object, is to provide a new and improved 3-position electric cord as well as a 3-position pull chain electrical selectively switching means, both of which switching means having an electrical "off"; "half-on" and "on" switching positions for at least generally illuminating at least one single filament lamp of an incandescent lamp fixture into at least the "half-on" and "on" illuminations, and also for illuminating at least one 3-way lamp into at least one or any of the previously disclosed 8 groups of 3, illuminating conditions, in a facile, economical, efficient, new and improved way. This is true especially when, for example, the lamp socket means is out of reach, or it is generally difficult or even may be impossible to be reached by hand, as when the cord switch or the pull chain of a large diameter lamp is used, in and at the combination fixture device.

Another further object of my invention is to prevent by a very cheap means, the electrical intermitting switching noise that is generally made by a SCR means, into a radio, hi-fi system and the like by simply having a half-wave, diode rectifying means for the dimming of at least one portion of at least one incandescent lamp in the combination fixture device.

And a yet further object of my invention is to provide an automatic electric clock lamp timer with an electrical selectively switching and a rectifying means for providing at least one incandescent lamp with a variable SCR incandescent lamp dimming means and/or a half-wave diode dimming means for thereby creating any desired dimmed illumination, so that, for example, the lamp's life may at least be extended, and at times, substantially 30 times, electricity is saved, and burn-out of the lamp or at least one filament thereof is greatly prevented, especially when a 3-way lamp is used, and especially when a person is away from home as when on vacation, or even when at least one lamp is illuminated and turned off each night in a remote area, for example. The automatic electric lamp and/or appliance timer to also have a "buss half-wave diode means," as desired, that is housed, for example, in a panel, plug-in, or in line type of buss fuse holder means for economically and efficiently changing the buss half-wave diode means whenever the diode rectifying means is "creamed", "blown", "shorted closed", "open", defective or becomes defective, for example, by an electrical overload or excessive electrical current demand thereon or even by lightening, if so desired. Dimmed variable or even a half-wave "on" incandescent illumination of at least one or even two separate single element lamps or one or two filaments of at least one 3-way lamp, provides further lamp burnout safety.

BRIEF DESCRIPTION OF THE DRAWINGS

FIGS. 1 and 2, is another fragmentary cutaway side elevational view of still another knob or even a pull-chain embodiment of a ceiling and/or wall (not shown) hung type of an electric incandescent lamp of the chandelier, and/or even a single electric incandescent lamp dimming combination fixture device.

FIG. 21 is a fragmentary side elevational plan view showing at least the construction and arrangement of an electric selectively switching and diode subcombination means and how the switching means, of the subcombination, is manually actuated for alternative, as desired, use in the, for example, FIGS. 1–7 embodiments of the present combination fixture device.

FIG. 22 is substantially a front elevational view taken along line 1—1 of FIG. 21.

FIG. 23 is a fragmentary side elevational plan view showing at least another construction and arrangement of an electric selectively switching and diode subcombination means and specifically how the switching means, of the subcombination, is also manually actuated for alternative, as desired, use in the, for example, FIG. 1 embodiment of the present combination fixture device.

FIG. 24 is a fragmentary front elevational plan view taken along line 2—2 of FIG. 23.

FIG. 25 is a fragmentary side elevational plan view of a dual, rotary and axial, selectively switching and dimming means which is substantially housed substantially in the base of an incandescent lamp socket means of one embodiment of the combination fixture device.

FIG. 26 is a fragmentary side elevation plan view of an alternatively selectively switching, leaf contact means, of the, for example, cherry and/or micro switching means shown in FIG. 25.

FIG. 27 is a horizontal side view of a "Buss-Diode" cartridge device which is an electrical half-wave semiconductor component rectifying subcombination device for use in any embodiment of the combination fixture device, as desired.

FIG. 28 is another embodiment of an air permeable, heat escaping, center tubing portion of the Buss-Diode cartridge device from that shown in FIG. 27.

FIG. 29 is another embodiment of an air permeable and heat escaping Buss-Diode cartridge device in that at least one of the metal end caps have at least one diode "air cooling" or diode "heat escaping" opening therein.

FIG. 30 is a fragmentary side elevational plan view of another embodiment of a "cherry or micro" type of electric selectively switching subcombination means having its electric switching depressible button means in direct contact with an outer end portion of the rotating and axial moving rod-like switch actuating member of that shown in FIG. 25, for example.

FIG. 31 is a fragmentary dashed-line portion of a half-wave "lamp dimming clock timer," being at least for incandescent lamps, that have at least the shown electric-schematic circuit diagram therein, and which timer being of the Plug-In, electric extension cord plug-in and/or Techni-Timer and the like type.

FIG. 32 is an alternative fragmentary electric-schematic circuit diagram of a variable electric incandescent lamp dimming means which may be desired to be used in place of or also additionally have the half-wave diode portion of the electric circuit diagram which is shown in FIG. 31.

FIG. 33 is a dashed-line fragmentary outlined incandescent lamp dimming photoelectric, for example, available light, control means having at least one portion of the shown electric-schematic circuit diagram therein.

FIG. 34 is a side elevational view of an incandescent lamp dimming, cordless plug-in, clock timer device.

FIG. 35 is a side elevational view of an incandescent lamp dimming photoelectric lamp socket control device.

FIG. 36 is a side elevational horizontal view of a "MOV" (metal oxide varistor) Electric Cord Device being attached to an electric cord means which has an electric cord plug-in means at one end thereof while the other end of the cord is electrically connected (not shown) to an electrical device having and not having semiconductor components therein, accordingly.

FIG. 37 is a side elevational view of an electric-cord selectively switching incandescent lamp, half-wave, dimming means being electrically connected to a fragment of an electric cord member which is one member portion of at least one of the electric incandescent lamp fixture devices.

FIG. 38 is a fragmentary side elevational view of a single filament (not shown) Edison Base electric incandescent lamp 9, improved device, having its electrical base contacting portions in contact with both generally center electrical contacts of a 3-way lamp socket means.

DETAILED DESCRIPTION OF THE INVENTION

Figures 1, 2, 3, 4, 5, 6:
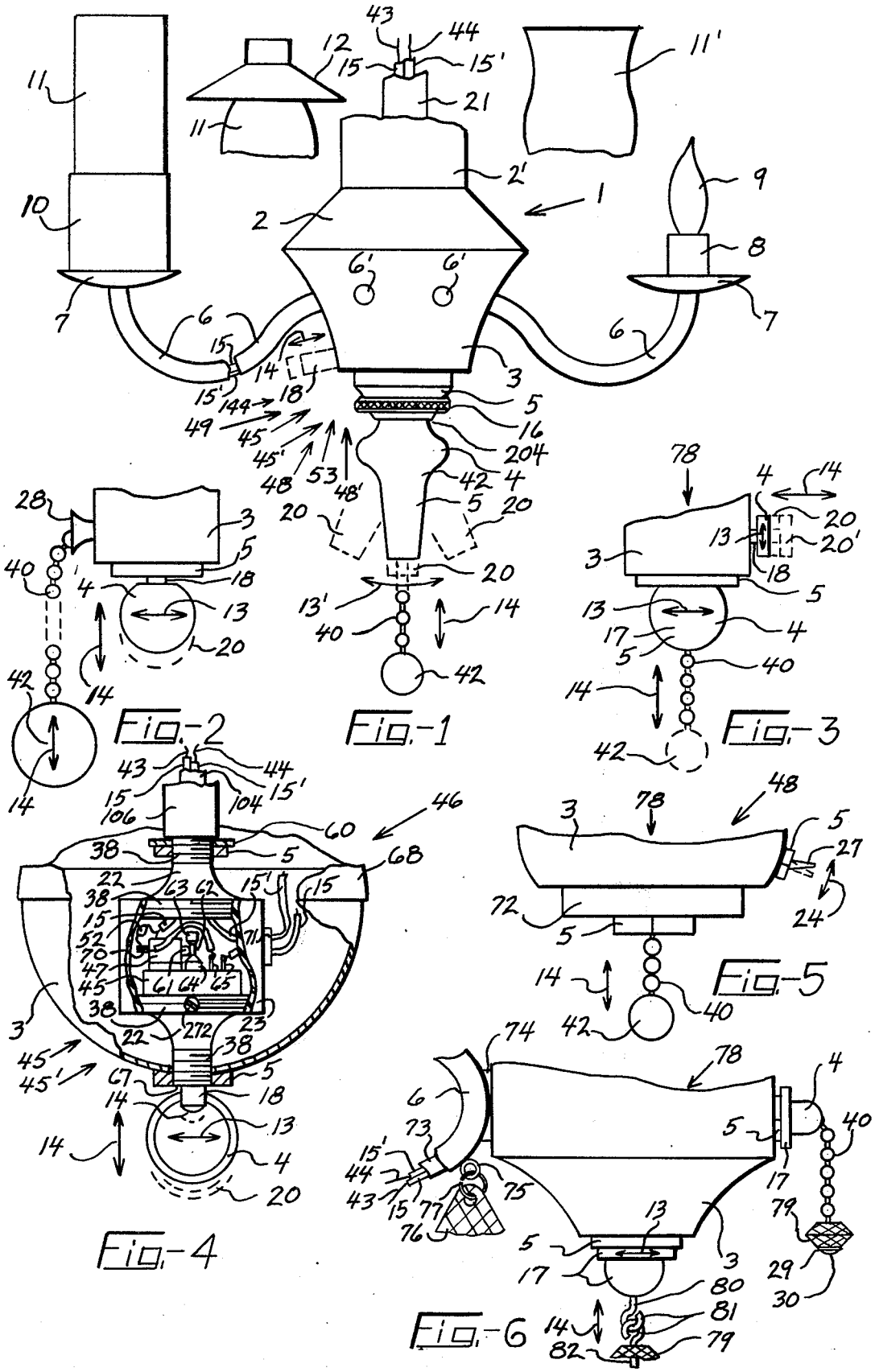
FIG. 1 is a partial side elevational view of, for example, an electric incandescent lamp dimming chandelier combination fixture device or invention, of the ceiling and/or wall (not shown) hung type. Also, shown are fragmentary side elevational views of various styles of lamp shades which other styles of chandeliers (not shown) generally have accordingly.
FIG. 2 is a fragmentary side elevational view of only the lower portion of another chandelier type or style of an electric incandescent lamp dimming chandelier and/or even a single incandescent lamp dimming, ceiling and/or wall hung, combination fixture device.
FIG. 3, as is
FIG. 4 is a fragmentary, partially cut-away, side elevational view of another lower portion of a ceiling and/or wall (not shown) supportingly suspended style or type of an electric incandescent lamp dimming combination fixture device.
FIG. 5 is still another fragmentary side elevational view of the bottom portion of a chandelier style or type, and even a single incandescent lamp dimming combination fixture device.
FIG. 6 is a yet another lower fragmentary side elevational view of a different type of style of an electric incandescent lamp dimming combination fixture device.

FIG. 1 shows a hung electric incandescent lamp dimming fixture device 1, shown by arrow means, of the chandelier style or type having in its fixture portion a tubular 21 center portion through which a conventional electric-cord member 15 is conventionally threaded. The cord 15 having two conventional electrical conducting wire members 43 and 44 therein. The other end (not shown) of the wire members 43 and 44 to be electrically connected directly to a, for example, 115 VAC source of electric current in the known conventional manner within an electrical, wall or ceiling mounted, box member (not shown) or indirectly to the electric current source by use of any conventionally known electric cord plug-in member 110 shown in FIG. 37. The plug 110 plugs into, for example, a conventional electric wall mounted electric outlet receptacle 111 which is partially shown in FIG. 34, in dashed line outline. The electrical conductor means 43, for example, is electrically connected to the electric-selectivity switching 47 and half-wave diode semiconductor rectifying 52 subcombination means 48 which is shown in the electric circuit diagrams of FIGS. 9, 11, 13, 15, 16, and 19, for example, to be used as desired, at least in any of the embodiments of the hung type of incandescent lamp combination fixture device, disclosed in this specification and drawings thereof.

The FIG. 1 further shows one of, at least two lamp, socket 8 supporting gracefully scrolled tubular arms 6, and at least two arm 6 insertion or securing openings 6', the lower 3 arm 6 and conductor wire 43 and 44 distribution fixture portion of the chandelier fixture 1 to show that at the fixture portion of the fixture device 1 could have, for example, at least two arms 6, lamp sockets 8, candelabra flame tipped or rounded lamps or bulbs 9, and even up to say 2 to 20 of the arms 6, accordingly as desired, and with or without the lamp socket dished, curved or plain base 7, as desired. The at least 2 to 20, for example, arms 6 may also have the alternative style of tubular lamp shade 11 supporting base 10, or the wagon wheel style of shade 11 having a cap like shield 12, or the hurricane shade 11' style of fixture portion of the chandelier fixture device 1 also as desired accordingly. The fixture portion of the fixture device 1 also being supportingly hung by a tubular-like member (not shown) since it is well known in the art, or it may be supportingly hung by at least one chain member 23, one of which is shown, for example, in side elevational fragmentary hanging view, in FIG. 7. The at least one chain 23 style is well known in the chandelier hanging art and also in the, for example, even the decorator, empire tiffany and the like style of swag lamp fixture means art and generally having the one swag chain 23, as is shown fragmentarily in FIG. 7, for example, and well known in the single chain 23 or even the swag chain 23 art, accordingly. At least one combination fixture portion of the fixture device 1 may also have a conventional center light or lamp 9 (not shown) if desired.

The FIG. 1 chandelier combination fixture 1 means also shows, by-arrow means, that the variable incandescent lamp dimming means 45 or 45' may also be substantially housed in the lower fixture base 3 portion thereof, as desired. The lamp dimming means 45 or 45' having thyristor 53 or triac 53 type of electric circuit diagram was fully disclosed in the specification of my Ser. No. 240,605 copending application and was shown in FIGS. 6 and 7of the drawing of my copending application Ser. No. 25,994 filed Apr. 6, 1970, along with the showing by arrow means to FIGS. 1, 2, 3, 4, 5 and 12, in the drawing of this specification, that also indicated that the dimming means 45 or 45' was also substantially housed in one portion or in one lower base fixture portion of the various shown electric incandescent lamp dimming combination fixture devices.

Figure 7:
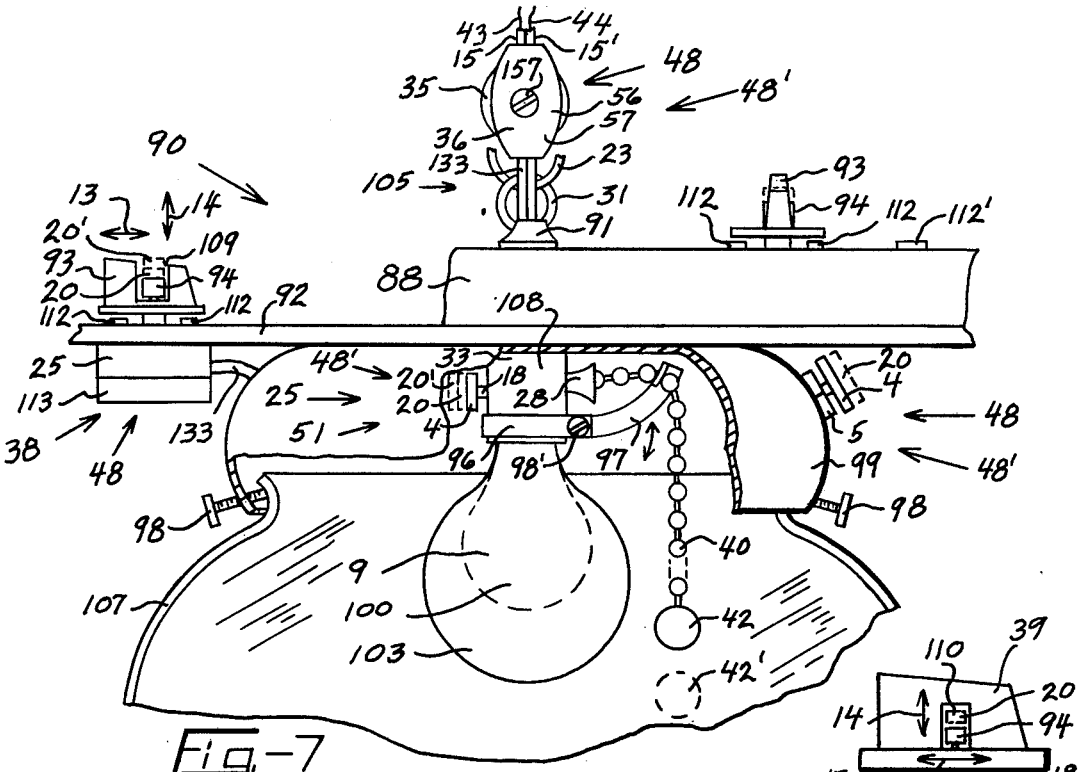
FIG. 7 is a still another fragmentary and partially cut-away side elevational view of a swag-chain and/or a chain-hung style of decorator, tiffany and the like incandescent lamp dimming combination fixture device.
Figure 8:
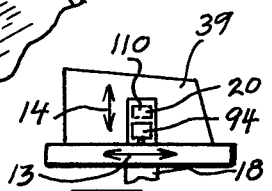
FIG. 8 is a fragmentary side elevational view of a unique knob means for at least a dual actuation of an electric selectively switching means which is used with at least one embodiment of the present invention.
Figure 9:
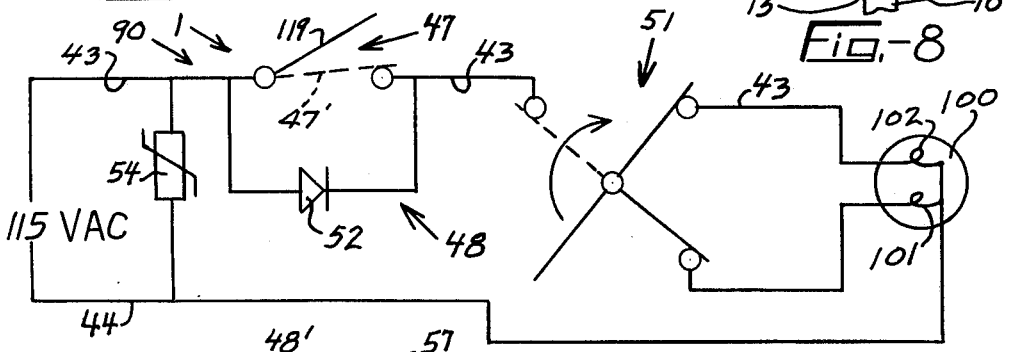
FIG. 9 is an electric-schematic circuit diagram usable in at least one embodiment of the present invention.
Figure 10:
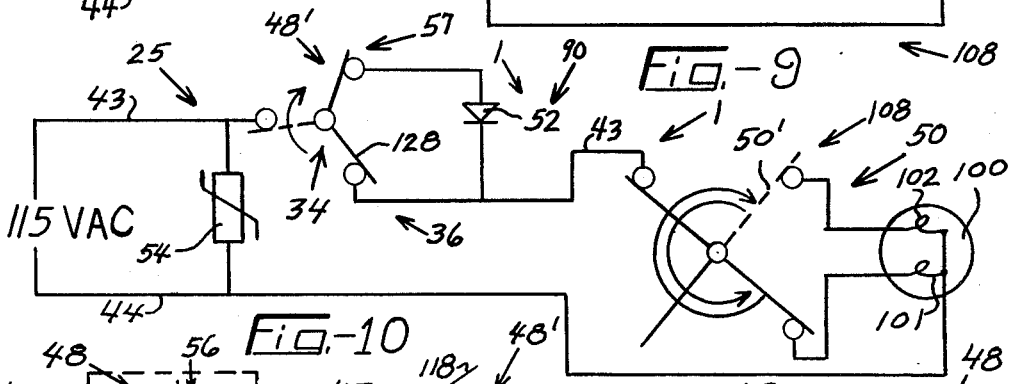
FIG. 10 is another unique and different alternative electric-schematic circuit diagram usable in at least one of the embodiments of the present invention, and having a back and forth selectively switching means.

FIG. 1 further shows by arrow means designation the subcombination means 48 and 48' having an electric selectively, 2position 47 or 3-position switching means 34 as shown in FIGS. 9 and 10 respectively. The switching means 47 or 34 and half-wave diode semiconductor rectifying means 52 may also be or be substantially housed, as a subcombination 48 and 48', in the fixture's lower base portion 3 of the combination fixture device 1, or in the base portion of lamp socket 33 means as is shown in FIGS. 7, 21, 23 and 25, for example. The improved electric selectively switching means 38 or 39 which are shown in FIGS. 7 and 8 respectively, may also be combined with the device 1 and the lamp socket means 33, as desired. One of the subcombinations 48 is substantially shown in FIGS. 4, 21, 23, 25 and 30, and in the electric circuit diagrams of FIGS. 9, 11, 13, 15, 16, 19, 31 and 33, accordingly.

Figure 15:
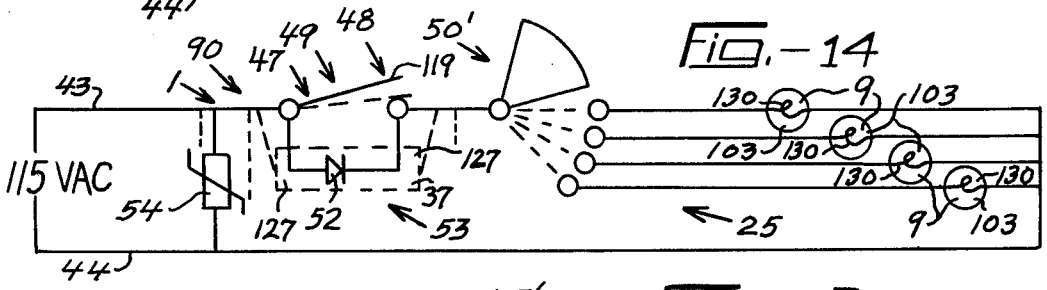
FIG. 15 is a yet further alternative, as desired, electric schematic circuit diagram usable in at least one of the embodiments of the present combination fixture device.

FIG. 1 still further shows, by arrow means designation, that a subcombination means 49 may also be substantially housed in the lower fixture base portion 3, as desired. The subcombination means 49 being composed of the subcombination means 48 and having the half-wave diode 52 housed in substantially a buss-fuse cartridge 37 as is shown in FIGS. 15, 16 and 31, for example.

Figure 16:
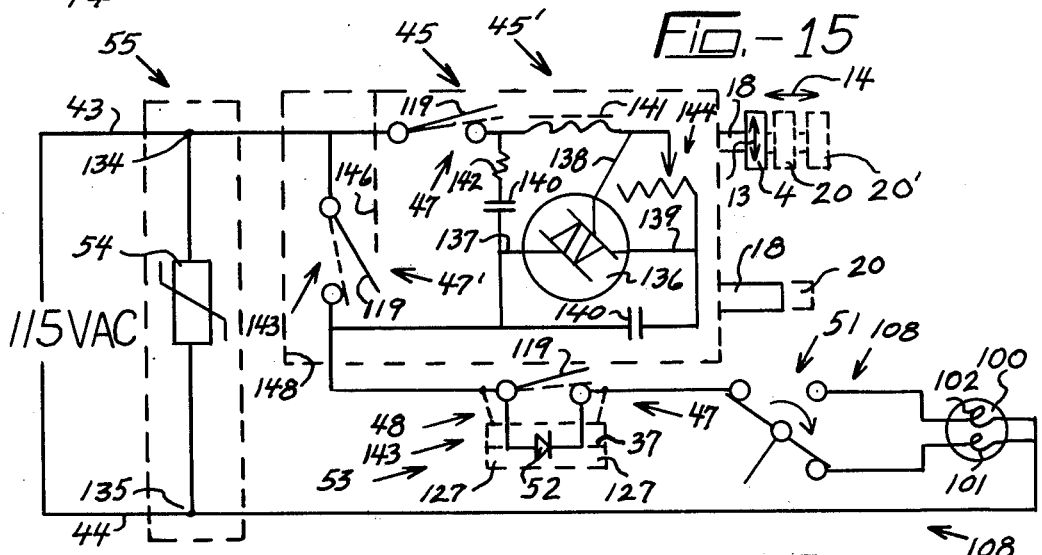
FIG. 16 is an alternative, as desired, electric-schematic circuit diagram of at least a variable incandescent lamp dimming circuit diagram usable in at least one embodiment of the present combination fixture device.

Also shown in FIG. 1 by arrow means designation 53 that the Buss-Diode subcombination means, as shown in FIGS. 27, 28 and 29 may also be housed in the fixture's lower base portion 3, accordingly as desired, and generally in the combination as shown in FIG. 16 circuit diagram.

FIG. 1 also still shows an electric selectively switching pull-chain 40 having a pull-chain end ball 42 or a decorator pull-chain end 42, of so desired, instead of substantially pivotally rocking the knob 4 to its universally dashed line moved positions 20. A threaded nut 5 removably secures at least the base 3 to an upper portion 2 of the fixture device 1 so that manual back and forth actuation of the subcombination switch means 48 into its electrical full "on" or into its "dim" half-wave rectified position by use of the diode 52, which is shown in FIG. 4, so that at least one lamp 9 dimming illumination is provided as desired. The above knob 16 and connecting or actuating construction is fragmentarily shown in FIGS. 23 and 24 in combination with a, for example, "Levolier" type of switching means 144. In FIG. 1 should the pull chain 40 be used, even with a Levolier type of switching means 144, then a subcombination means 48 may be actuated by back and forth rotation of knob 17 as is shown in FIGS. 21 and 22, for example. In FIG. 1, the decorative knob 4 may also be axially and/or rotatingly manually moved for use with the variable dimmer means, 45 or 45′ or the subcombination means 48 or even 49, if so desired, as is in FIG. 1 of my copending application Ser. Nos. 240,605 and 25,994, or as in FIG. 4 of this specification. Thereby the decorative knob 4 of FIG. 1 would not be universally movable as is shown in FIG. 1. The knob 4 would become a pull-chain end, decorative pull, member 42 should it be desired to substantially conceal the chain 40 or even a substantially concealed wire-like member 80, as is shown in FIG. 6, for example.

The FIG. 1 also shows a dashed line outline of a rod-like member 18, which may also be rotationally and/or axially manually moved, if so desired, for actuation of the variable dimmer means 45 or 45′ or for actuation of the subcombination means 48, as desired. Thereby the decorative knob 4 or the rotating knob 16 would be merely ornamental in appearance only or one or both of the knobs 4 and/or 16 may even be illuminated, as desired. The decorative knob 4 may also be internally threaded and thereby be used in place of the nut 5, if so desired.

FIG. 2 shows an alternate embodiment of the combination fixture device 1 in that the lower fixture base portion 3 has a decorative substantially round knob 4 secured to a rotating 13 only rod-like member 18 or to an axially movable 20 and rotating 13 rod-like member 18 which is either, as desired, an extension of the variable dimming means 45 or 45′, or an extension of the subcombination, switching and half-wave diode, means 48. A conventional pull-chain member 40 having a conventional pull-chain guiding funnel shaped, member 28 may be used, if so desired, at a side wall portion of the lower base portion 3, for actuating a two-position "on and off" selectively switching means 47 as shown, for example, in FIG. 9; or for actuating a 3-position "off and half-on or dim and an on" selectively switching means 34 of the subcombination means 48 as is shown, for example, in FIG. 10; or for actuating a 4-position selectively switching means 51 as is shown, for example, in FIG. 9 whereby the substantially round knob 4 would be either pulled and pushed 14 or fully rotated or rotated back and forth to actuate, as desired, the switch means 47 of the subcombination means 48 shown in FIG. 9, for example, or the switch means 47 of the subcombination means 48 shown in FIG. 11, for example. It is also to be understood that the pull-chain member 40 may be used, as desired for example, for only actuating the switch 47 of the subcombination means 48, shown in FIG. 9; or the switch 34 of the subcombination means 48′ shown in FIG. 10, whereby the knob 4 would now be a substantially round threaded nut 5, if so desired, and thereby the nut 5 could be eliminated accordingly, as desired. A large decorator pull-chain end member 42 is also shown.

FIG. 3 shows another embodiment of the lower fixture base portion 3, of the fixture device 1, wherein the pull-chain member 40 exits out from a center counterbored or non-counterbored opening (not shown) of the substantially round knob 4; or a substantially round knob 17, which is generally shown in FIG. 21 and 22; or the substantially round nut 5 which is disclosed in FIG. 2, for example, as desired. The pull-chain member's 40 showing and/or use is further fully disclosed in FIGS. 1, 2, 5, 7, 21 and 22, for example. A side mounted rotating 13 and/or axially movable 14, either 2-position or 3-position, knob 4 is also shown mounted on a rod-like member 18 which is an extension of the variable dimmer 45 or 45′ or is an extension of a subcombination means 48, 48′ or 49 for use as was disclosed in FIGS. 1 and 2 accordingly. A nut 5, as shown in FIG. 5 on the side of the base portion 3, may also be used with the rod-like member 18 for aiding in securing the above disclosed dimming means 45, 45′, 48, 48′ or 49 to a wall portion of the lower base portion 3, as desired. A large nut 5 is also shown in FIG. 3, for substantially securing the fixture portion of fixture device 1 together, as is well known to persons skilled in the chandelier art.

FIG. 4 is another lower embodiment 46 of the fixture portion of the combination fixture device 1 showing the lower base portion 3 of a, for example, Williamsburg style of chandelier. The base portion 3 is fragmentarily cut-away to expose one of the various disclosed constructions of the subcombination means 48 or 49 therein, for example.

In FIG. 4 the two electrical conductor wires 43 and 44 are fragmentarily shown extending out of, for example, a conventionally two electrical conductor insulating member 104 which has substantially the two electrical insulated 15 and 15′ wires 43 and 44 extending therefrom. The electrical insulated members 15 and 15′ may also be a conventionally joined twin insulated cord member designated by arrow means 105 as is also shown in FIG. 7, and is shown by numeral 133 in FIGS. 36 and 37, for example, depending on "UL" approval. The outer insulating cover 104 would thereby not be used, as desired, as shown in FIG. 4.

The FIG. 4 shows a threaded tubing member 106 engaging a lock washer 60 having a jam nut 5 thereagainst. The jam nut 5 is used for adjusting the length of the exposed end 67 of the lower threaded 38 fitting member 22, if so desired. But, the lock washer 60 and nut 5 could be eliminated, especially if a thread locking compound such as "Loctite", Eastman 910 cement or a red nylon ESLOK thread locking path material is used, for example, on at least the upper thread 38 of the upper fitting 22.

The FIG. 4 also shows the small and large threaded portions of the two fittings 22. The 2 large threads 38 are each threadingly engaged into two threaded ends of the center tubular member 23. The upper fitting 22 and the upper end of the member 23 could be made as an integral one piece member, if so desired. A threaded nut 5 which may have one of its face edges curved as shown, if so desired. The lower nut 5 removably secures the lower, substantially round, member 3 to the upper half 68 of the lower substantially Williamsburg 46.

FIG. 4 shows two cut off insulated 15 and 15' electrical conducting wires 43 and 44 extending from the tubing 106. One end of wire 43 is electrically connected to one of conventional the two or three electrical terminals 70, being one or two that is hidden behind the one shown electrical terminal 70, of switch 47 means. The shown electrical terminal 70 is electrically connected to a short length of electrical wire (not numbered) which is electrically connected to one electrical wire or terminal 65 extending out of the variable dimmer means 45. Another length of insulated wire 43 is electrically connected to the shown second terminal 65 and then extendingly exists through an insulated gromet member 71 along with the other insulated 15' wire member 44. The two electrical wires 43 and 44 are then extended substantially upwards for electrical connection to at least 2 lamps 9 (shown in FIG. 1) for providing a desired variable dimmer 45 controlled illumination for at least 2 lamps 9 and at the same time automatically maintaining a desired dimmed lamp 9 illumination setting regardless of whether or not the electrical current supply is switched "off" and back "on" to the dimmer means 45 and at least 2 lamps 9, by merely axially manually moving 14 the knob-like ring member 4 to its dashed line 20 position along with the rod-like member 18. Thereby the micro or cherry type of switch 47 actuating button 61 is depressed into the switch 47 by the large end 63 as the extension 64 of the member 18 is axially moved 14 downwardly for actuating the switch 47 into its open position, as is generally shown in FIG. 16, for example. The switch 47 may also have a half-wave diode rectifying means 52 electrically connected to and between the hidden and shown electrical terminals 70 for thereby passing a half-wave of the electrical current source substantially to the dimmer means 45 or at least 2 lamps 9. Thereby variable dimmer means 45 will only be able to variably dim at least 2 lamps 9 from its half-wave illumination to a variable illumination below that of the half-wave illumination, if so desired, as is also generally shown in FIG. 16. An extension means having a hook-like member (not shown) may also be inserted into the center of the ring member 4 for rotating 13 and/or axially moving 14 it when the chandelier is out of direct manual reach, for example.

FIG. 5 shows another embodiment of the lower fixture portion of the base portion 3 of a wagon wheel style of a chandelier combination fixture device 1. The hub-like portion 72 having a conventional threaded nut 5 secured to the threaded end 38 of a fitting 22 as shown in FIG. 4, and as is generally shown in FIG. 23, for example. The pull-chain member 40 is manually pulled, as is shown by arrow means 14 for at least actuating a subcombination means 48 having the rotating two position switching means 48 having contacts or members 117 of FIG. 11 of the three position switching means 34 of FIG. 10. The lamps 9 of FIG. 1, or the lamps 9 of FIG. 7 wherein the latter FIG. 7 the lamp 9 may be the conventional type of single filament 102 lamp 9 or the two filament 101 and 102 lamp 100; or the large decorative 3500 hour lamps 103, as is generally shown in FIGS. 7 and 16, for example. The pull-chain 40 end pull member 42 is also shown, as is the manual actuating portion of a selectively switching, two position, by-passing switching means 47' as is shown in FIG. 16 or the 2-position switching means 47 of subcombination means 48 as shown in FIG. 9 or even the 3-position rotary switch 34 of subcombination means 48' as shown in FIG. 10, for example. The pull-chain member 40 may also be used for actuating the 4-position, 3-way, switch means 51 as shown in FIG. 9 and 16, if so desired. The paddle or toggle type of switch operatively actuating member 27 is also shown in its solid and dashed-line positions. The threaded nut 5 is used for removably securing the disclosed electrical switches to the side wall portion of the lower fixture base portion 3, in a conventional manner.

FIG. 6 shows another embodiment of the lower fixture base portion 3 of a crystal chandelier of the combination fixture device 1. Shown is a fragmentary portion of tubing arm 6, insulating outer covering 104 shown in FIG. 3 and, insulated 15 and 15' electrical wire members 43 and 44 extending from one cut away end 73, a tubing arm supporting member 74, ring member 75, fragment portion of crystal 76, supporting ring 77, threaded nut 5, subcombination means 48 switching knob member 4 which is for actuating for example, a levolier type of switch 47 or a levolier switch knob 4 means which may be directly manually universally moved or may be substantially pivotally moved downward by manually pulling on the pull-chain member 40 for actuating the levolier electric selective switching means 78 which is also to be used in FIGS. 3 and 5, if so desired. The levolier switching means 78 also being switching means 47 and 34 respectively, for example, in that it may be the subcombination means 47 or 49 of FIG. 19, or the subcombination means 48' of FIG. 20, or the subcombination means 48 of FIGS. 9 and 21 or the subcombination means 48' of FIGS. 10 and 21, as desired.

FIG. 6 further shows a pull-chain member 40 end pull member 79 which is unique in that it is a crystal pull-chain member 79 for matching the crystals 76 and the like of the crystal combination fixture device 1. The crystal member 79 may have at least one generally resilient washer member 29 which may be made of polyurethane nylon, styrene and the like generally resilient plastic material or a rubber and the like resilient material, or the washer 29 may be replaced with a coiled compression spring (not shown) for absorbing at least some pull-chain, actuation created shock, whereby breakage of at least the crystal member 79 is at least minimized or is substantially eliminated. The wire-like member 80 which is shown extending from the rotating knob 17 has a looped hook-like end 81 which is hooked onto another hook-like end 81 of a wire like member 82 which also may have its other end (not shown) constructed and having the resilient member 29 and large head 30, as was disclosed for the crystal, pull-chain member 40, end pull 79. The hook-like ends 81 may be eliminated, if desired, whereby the wire like member 80 would be threaded through the crystal 79 member as a further object of actually concealing the fact that the crystal chandelier combination fixture device 1 has at least one strung crystal 79 ended pull-chain 40 or a pull-wire 80 means accordingly, whereby the side mounted levolier switch 78 and its switching knob 4 would be eliminated, if so desired.

Figure 19:
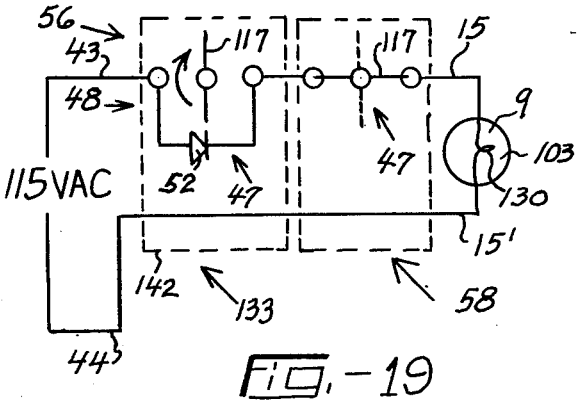
FIG. 19 is another further alternative, as desired, electric schematic circuit diagram having at least another selectively switching and diode subcombination means usable in the present combination fixture device.
Figure 20:
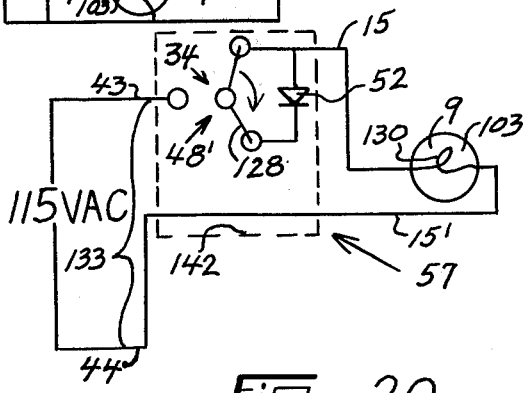
FIG. 20 is a yet further alternative, as desired, electric schematic circuit diagram having at least a still another embodiment of an electric selectively switching and diode subcombination means, usable in the present combination fixture device.

FIG. 7 shows a chain or a swag-chain hung electric incandescent, single, lamp dimming combination fixture device 90 which is designated by arrow means and which is also substantially entirely shown in FIG. 3 and disclosed along with the objects thereto in my copending application Ser. No. 25,994 filed Apr. 6, 1970. The disclosure in the copending application is to be deemed as being incorporated in this specification accordingly. FIG. 7 shows electrical wire conductors 43 and 44 extending from the fragmentary electrical twin lamp cord 113 having members 15 and 15'. The electrical lamp cord members 15 and 15' have a miniature feed-thru, wheel 35 type of 2-position 47 electrical selectively switching cord means 56, as is generally shown in FIGS. 9 and 19, and shown therein as having the diode 52 means electrically connected thereto for forming the subcombination means 48. The electric switching means 56 may also be replaced by a 3-position "off", "dim" and "on" wheel type of miniature electric cord feed-thru selectively switching means 57 which is generally shown in FIGS. 10 and 20 as switch 34 means having the half-wave diode rectifying means 52 electrically connected for thereby forming the subcombination means 48'.

FIG. 7 also shows the electric cord switching means as having a conventional feed-thru switch casing 36 securing rivet or screw member 157, having a threaded nut 5 on its other threaded end (not shown) as is substantially conventionally done in the lamp fixture art.

Figure 14:
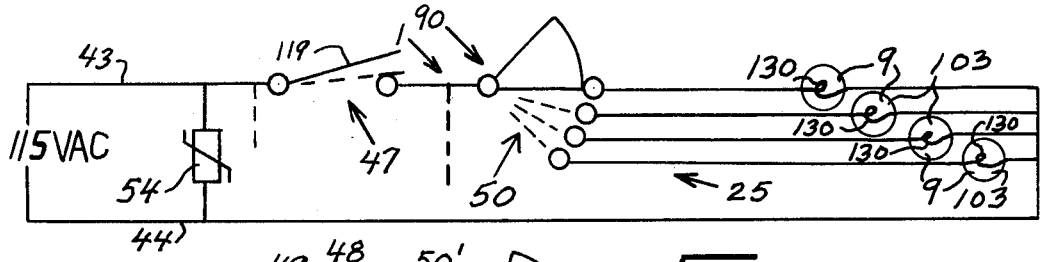
FIG. 14 is another still further alternative, as desired, electric-schematic circuit diagram usable in at least one of the embodiments of the present alternating electric current incandescent lamp dimming combination fixture device.
Figure 18:
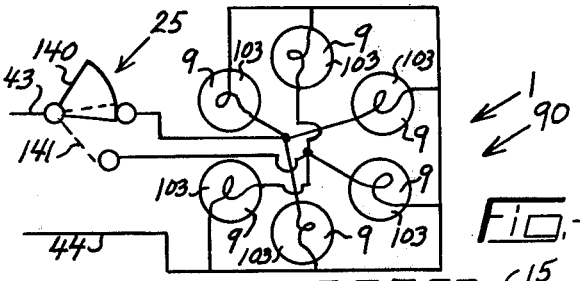
FIG. 18 is still another alternative, as desired, of still another fragmentary electric-schematic circuit diagram of still another electric-selectively switching and incandescent lamp means usable in the present combination fixture device.

FIG. 7 also shows a unique lamp socket embodiment 33 which has a dual selectively combination switching means 25 and 50 in that the main combination switching means 25 and 50 has no electrical "off" position, as shown in FIGS. 18 and 10 or 14 respectively. A subcombination means 48' having the no electrical "off" position, and as desired, as disclosed in the objects.

FIG. 7 further shows a fragmentary portion of a chain or a swag-chain member 23 being hooked onto the conventional ring-like fitting member 31 having a conventional base portion 91 which secures the chain member 23 to an elongated switch housing 88 means, for example.

Also shown is the conventional elongated fixture 90 supporting member 92, pull-chain 40 lamp socket means 33 having the subcombination means 48' therein, being the 3-way switching means 34 and diode 52, of FIG. 10 or even 20, for example. The conventionally small rounded single filament lamp 9 or the large Duro Lite 3500 hour lamp 103 or a two filament 3-way lamp 100 is also desired and shown. An end pull means 42 is also shown in its returned and actuated dashed-line position 42'. The pull-chain 40 lamp socket 33 conventionally extending and outwardly pivoting arm 97 is shown secured to the lamp socket 33 clamping member 96 by means of a rivet or screw means 98 so that the pull-chain 40 will be easily pulled and returned into the socket 33 through the pull-chain 40 guiding member 28 and/or so that the pull-chain 40 will clear the large lamp 103 when the chain 40 is actuated. An "off", "dim" and an "on" illumination of the lamp 9 and/or 103 is thereby obtained.

FIG. 7 also shows the conventional lamp fixture cap member 99 and large lamp 9 dome 107, which if used, would eliminate the use of pull-chain 40 and members 96 and 97 accordingly. This is where the cord switch 56 or 57 means is very needed, useful and necessary, as is the special dual switching means 25 and its special rotating knob 93 and axially pulled and pushed knob 94 means.

The dual electric selective switching means 25 consists of, for example, a 1 to 4 or 5 position 50 or 50', as is shown in FIG. 10, and being an Arc-Les, Aetna E11871, Tower rotary snap switches series 3500 and/or 3580 and the like rotary, back and forth only, selective switching means which is combined with at least one micro, cherry and the like selectively switching 47, 2-position means, as is generally disclosed in FIG. 4 and also shown and disclosed in FIGS. 9, 13, 14, 15 and 17 for example, with and without the half-wave diode 52, as is desired, depending on the desired application of the dual electric selective switching means 25.

The FIGS. 4, 25 and 30 generally show how the switch 47 means is actuated and FIG. 26 shows how a leaf electrical contacting means may also be used in place of a micro or cherry 47 type of selectively switching means, and if so desired, with the dual switching means 25, when the center knob 94 of FIG. 7 switch 25 is desired to be actuated, with or without a half-wave diode 52 in electrically connected combination therewith for forming the subcombination means 48 or even 48', and being used at least in electrically connected combination with the altered and improved rotary snap action, back and forth, selectively switching means of the TOWER series 3500, 3580 and the like, disclosed hereabove, especially when the rotary or even a rotary TOWER type or the like back and forth actuated selectively switching means 50, 48, and 25 as is shown in FIGS. 10, 11, 14 and 18, accordingly. The lamp socket 33 means embodiment shown in FIG. 7, for example, which socket 33 means is for use in table, floor, hung lamp 9, 100 and/or 103 incandescent lamp fixtures means and the like, that are also to have the no electrical "off" selectively switching means 25, as is shown in FIG. 7, wherein the knob 4 is shown mounted to the rod-like member 18. The knob 4 rotates the member 18 which is rotated 13 for actuating the selective switching means 25, 48' or 50, as is shown in FIGS. 10 and 11, 14 and 18. It should be noted that when the 3-position switch 25 or 34 of FIG. 10 is in its electrical "off" position, that no electrical current is passed to the 3-position switch 50 means, shown in FIG. 10, regardless of how the knob 4 of the switch 50 means is rotated. It is not until the knob 4 is, for example, axially pulled out to its dashed line position 20 that the switch 25 of FIGS. 7 and 12 for example, is first actuated to its "dim" half-wave diode 52 position and upon further axial pulling of the knob 4 to its shown dashed line "on" position 20; whereby the "low" filament 102 or the "high" filament 101 or both the "low" 102 and "high" 101 filaments of FIG. 10, for example, being thereby either in their "off", "dim" half-wave or "on" desired position, without having to first pass any electrical current supply to filament 102 or 101 or both filaments 102 and/or 101 prior to selecting exactly which filament 102 or 101 or both filaments 102 and 101 is desired to be illuminated. This is because of the fact that the filament 102, 101 or filaments 102 and 101 "off" and "on" electrical conditions are controlled by the axial pulling out or the reverse in that the axial pushing in of the knob 4 means allows at least one portion of the source of electrical current supply to pass to the preselected or the prior set switch 25 or 50 position. At least the various 8 combinations of three, lamp 100 illuminating conditions as disclosed in the objects, is thereby made possible.

Other objects of the dual lamp socket switching means are generally disclosed to or shown in FIGS. 1, 4, 9–26 and 35 of my Ser. No. 240,605 copending application.

The half-wave diode rectifier means 52 and/or the variable lamp 9, 100 and/or 103 dimmer control means 45 or 45′ may be eliminated in part or in whole or be totally incorporated together, as is shown in FIG. 16, for example, as desired for obtaining various disclosed objects, accordingly. The electric cord switch means 56 and 57 shown in FIGS. 7 and 37 may also be of the lever type, slide type, push button type, rotating knob 4 type, toggle type, a possible levolier type and the like type of electric switching means known in the switch art, in addition to or instead of the shown cord switch wheel 35 type, as desired.

Figure 11:
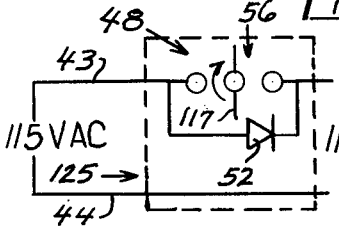
FIG. 11 is a fragmentary electric circuit switching diagram having a rotary switching means which may be used in place of the FIG. 9 two position switching means.

In FIG. 7 the pull-chain member 40 may be used for actuating, for example, a 2-position rotary switching means 47 which is shown in FIG. 11. The pull-chain operation would then be used in place of the axially pulling switch operation of knob 4 means, as desired. Thereby rotary, back and forth, movement of the knob 4, would at any desired time, preselect a desired filament 101, or 102, or even both 101 and 102 and then the pull-chain member 40 would be used to actuate the rotary "on-off" switch 47 shown in FIG. 11, for always illuminating the preselected filament 101 or 102, or even filaments 101 and 102, as desired, and yet the illuminated filament 101, 102, or even 101 and 102 may still be turned "off" at any desired time, from any low, medium or high illumination and directly back "on" accordingly as desired.

FIG. 7 shows the dual switch 25 mounted on the combination fixture device 90 support bar-like member 92 or, if so desired, on the elongated housing 88 top portion or on the dome 99 as is knob 4 of subcombination means 48 or 48′ which is shown by arrow means. The member 92 mounted switch 25 operation would be as follows, and even if switch 25 means is housed in the base of the lamp socket member 33 and/or 108, which is respectively shown in FIGS. 7 and 25.

A person would first rotate knob 93 clockwise or counterclockwise 13 for preselecting a desired filament 101 or 102, or 101 and 102 of lamp 100, or 1, 2, 3, and 4 lamps 9 as shown in FIG. 14 for example. Then the small center knob 94 would be axially and detentingly pulled out 14 to its first dash-lined 20 position, whereby the preselected filament or filaments or lamp or even lamps 100 would be illuminated into their "on" electrical illuminating state. Now if the first position 20 controls a half-wave diode 52 "dim" position, then the knob 94 would have to be pulled out 14 to its "on" full illuminating 2nd dashed-line position 20′ for fully illuminating, for example, the filament 101 or 102, or 101 and 102, by using two separate (not shown) switches 47. When the preselected filaments or lamps are desired to be turned "off" then a person merely axially 14 pushes the knob 94 back to its initial starting "off" position. The knob 93 has an open ended opening 109 therein which permits adjusting and removal of the knob 94 with or without knob 93 and for permitting the knob 94 to be manually axially moved in either one, two or three detenting positions.

The FIG. 7 threaded screws 98 removably secures the lamp, 9 or 100 or 103, dome 107 in position as shown. The globe 107 may be open or enclosed at its bottom (not shown) portion, as desired, whereby if it is closed, then the pull-chain member 40 and its lamp socket 33 could not be used as shown.

Figure 12:
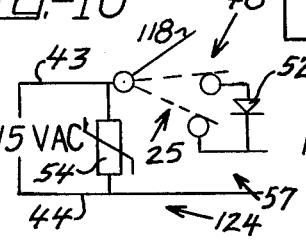
FIG. 12 is another fragmentary electric circuit switching diagram usable in place of the FIG. 10, for example, disclosed switching means.
Figure 13:
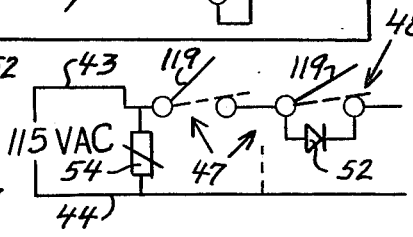
FIG. 13 is a still another fragmentary electric circuit dual selectively switching means, diagram usable in place of the FIG. 10 disclosed switching means, for example.

FIG. 8 shows a switch knob 39 portion of a rotary snap action electric selectively switching means 47 which has an "off" electrical selectively switching position as is shown in FIGS. 13 and 15. The knob 39 is shown with a closed ended opening 110 therein which captively retains knob 94 in its solid lined and in its dashed-line axially moved 20 position. Thereby the two closed ends of the opening 110 may act as an axial stop means for knob 94, if so desired. The rotary clockwise and counterclockwise 13 operation of the knob 39 and axial movement of knob 94, switching means 25 is shown and substantially disclosed in FIGS. 12 and 15, for example. The knob 94, shown in FIG. 7, may also be made to move axially only in two positions, if so desired.

FIG. 9 shows the 115 VAC supply of electric current source having a G.E.MOV. varistor 54 electrically connected across the electric conducting wires 43 and 44, for at least protecting the diode 52 from being creamed by high electrical current surges, voltage transients, and the like.

FIG. 9 shows electrical conductor wire 43 electrically connected to a subcombination means 48 which has a non-rotary 2-position "off-on" switch 47 means shown in its open, and its dashed line half-wave diode rectifying 52, lamp 100 dimming electrical current passing positions. When the switch 47 is in its dashed-line closed position 47′ then the electrically connected rectifier or rectifying means 52 is shuntingly by-passed. The switch 47 is electrically connected to a conventional 3-way electric selectively, for example, lamp socket 108, shown in FIG. 7 switching means 51 which is shown in its open "off" electrical position. When a 3-way incandescent lamp means 100 is inserted into the 3-way lamp socket means 108 then the disclosed 8 combinations of 3 separate illuminations from the lamp 100 and/or filaments 101 or 102, or 101 and 102 is thereby made possible, as disclosed in the objects.

Starting, for example, from the 115 VAC source of electrical current supply one end of the electrical conducting wire 43 must, of course, be electrically connected, regardless of which switches, subcombinations and the like is electrically connected therebetween, substantially to one end of the filaments 101 and 102 for completing all of that portion of the electrical circuit and then generally back through the second electrical conducting wire 44 to the 115 VAC source of electric current supply, as shown for example, in FIGS. 9 and 16. The rotation of the knob 4, shown in FIG. 25, will actuate the FIG. 9 switching means 51 into its four electrical conventional positions of one "off" and three "on" and the axial movement of the knob 4 or knob 94, shown in FIG. 8, will actuate the, for example, cherry or micro switching means 47 into their disclosed two positions as is structurally substantially shown in FIGS. 4 and 25, for example. The diode 52 and the switching 47 means of the subcombination means 48 do not necessarily have to be electrically connected in close relationship as is shown in FIGS. 4 and 25, if so desired.

FIG. 10 shows the source of electrical current supply 115 VAC means having a varistor 54 also electrically connected across the electrical wires 43 and 44. The electric conducting wire 43 means is shown electrically connected to a rotating 3-position electrical switching means 34 which has a half-wave diode rectifying means 52 electrically connected substantially to and between two of the electrical positions. The above is identified, by arrow means, as subcombination means 48′. Substantially the electric conducting wire 43 means is then electrically connected to an improved no electrical "off" clockwise and counterclockwise rotating 3-way electrical switching means 50 which is shown in its filament 101 electrical passing position. The switch 50 will be restricted from ever being in the electrical "off" position, as shown by the conventional switch 51 means in FIG. 9. The electric wire 43 is then electrically connected substantially to one end of the filaments 102 and 101, when a lamp 100 is inserted in the lamp socket 108, for example, and from the substantially other end of the filaments 102 and 101 the electric wire 44 means passes a rectified "dim" or a non-rectified full "on" of the electric current substantially back to the 115 VAC source of electric current supply.

The FIG. 10 rotary subcombination means 48' could be, for example, within the electric cord selectively switching means 56 and 57 of the wheel 35, of FIG. 7, and half wheel 35' miniature type, shown in FIG. 7, or the non-miniature slide or lever type. The two position switch 56 or the 3-position switch 57 could also be of the rotary levolier type of electric selective switching member 33 as is shown in FIGS. 6, 21 and 23, and be actuated by a pull-chain member 40 selectively switching means as shown in FIG. 7, or be a knob rotated, push-push, wheel 35 and the like type of rotating switch 34 means as shown in FIGS. 10 and 11.

In the FIG. 10 embodiment, taken with at least the FIGS. 11, 12 and 13 accordingly, a person, for example, walks into a room to an electric incandescent lamp 9, 100 or 103 combination fixture device 1 or 90, or even to a table lamp, floor lamp and the like (not shown) and then rotates 13 a knob 4 or 93 means for selecting a desired lamp filament 101 or 102, or 101 and 102 of a, for example, the three-way lamp 100, and then axially moves 14 the knob 4 or 94 in either the 20 or the 20' dashed line positions for effecting an "on" only; or a "dim" half-wave and an "on"; or a variable dimming only; or a variable dimming and "on" by-passing position of the selected filament 101 or 102 or the filaments 101 and 102, as desired. When the illuminated filament or filaments are desired to be completely turned "off" then the person merely axially moves the knob 4 or 94 to its original "off" electrical position. The knobs 4 or 93 are rotatable in a, for example, clockwise only or in a clockwise or counterclockwise direction, as desired, regardless of which of the two or three axial positions the knob 4 and/or 93 are in. The above is true for the knurled knob 16 and the universal actuation of knob 4, and substantially of the rod-like member 18 shown in FIG. 7 and in FIG. 1. The lower switch 47, in FIG. 7, cover or housing 113 substantially one or two separate cherry or micro and the like type of 2-position switch 47 which are for use with an axially moving rod-like member 18 as shown in FIGS. 4, 25 and 30.

The housing 113 could be eliminated, if desired, as is generally shown in FIG. 4, for example, but with UL approval. A 2-position switch 47 of the cherry type, for example, would be mounted substantially as shown in FIG. 4, on the housing of the variable dimming means 45, or on the bottom of the housing of switch 25 (not shown) in FIG. 7, but being on the inside of the switch 47 cover 113, which is shown in FIG. 7.

FIG. 11 shows the 115 VAC, electrical conducting wires 43 and 44, a subcombination means 48 having a rotary 2-position "off" and "on" switching means 56 which is electrically connected in parallel with the half-wave diode rectifying means 52. The FIG. 11 subcombination means 48 is substantially housed in an electric cord switch casing means 36, shown by arrow means, shown in FIGS. 7 and 37, and is to be used, as desired, in electrically connected combination with substantially any of the 2-position, 3-position and 4-position selectively switching means having an electrical "off" position, as desired. Also, it should be noted that the electric cord switch casing 36 having the subcombination means 48 and 48' and thereby being electric cord diode switches 56 and 57, as shown in FIGS. 7 and 37, are a unique subcombination device within themselves and used as disclosed in the objects, as desired. The subcombination means 48 may also be used in the neck portion of a table lamp, for example, before a lamp socket portion thereof, as is generally shown in FIG. 19, if so desired.

FIG. 12 shows varistor 54 means which could be integrally housed in the male electric cord plug-in member shown in dashed-line fragmentary outline in FIGS. 16 and 33. An electric cord 3-position selectively switching means 57 is shown having the subcombination means 48' therein or the subcombination means 48' may be used to replace the 3-position rotary switching subcombination means 48' shown in FIG. 10, for example, as desired. The 3-position switching means 118 of FIG. 12 may be used in axial moving 14 combination with the knob 4 or knob 94 of FIG. 7 or may even be a rotary, slide, lever, rocker, toggle, push-push, and the like conventional electric selectively switching means 25 and/or 57 as desired, and also as is generally shown in FIG. 7, for example, having the subcombination means 48' therein. The subcombination means 48 and 48' are also to be used in the neck lamp socket supporting portion 125 of a table lamp, floor lamp and the like, having the rotary 118 or the non-rotary 117 switch 118, 119 or 47 as is disclosed in FIGS. 11, 12 and 13 for example. The neck 125 tubular member is shown in dashed-line outline by arrow means, in FIG. 11 to also thereby obtain some of the disclosed objects.

FIG. 13 shows an electrically connected varistor 54, and a 2-position "off-on" electric selectively switching means 47 electrically connected serially with a subcombination means 48 having the 2-position switch means 47 of the cherry or micro type switch that is electrically connected to a half-wave rectifier 52. The micro or cherry two-position type of switching means are preferred to be used with the 3-position "off", "dim" and "on" axial moving knob 4 or the rod-like member 18 or even the axial moving knob 94 which are shown respectively in FIG. 7, for example, by means of the electric switch 25 or the electric incandescent lamp socket member 33, as desired. The FIG. 26 shows a 3 leaf electrical contacting means 120 which may also be used, as desired, with the 3-position of "off", "dim" 20 and "on" 20' of the axial solid and dashed-line shown positions of knob 4 and/or knob 94, as shown in FIG. 7 if so desired or found to be cheaper and passed by UL approval, with the diode 52 being electrically connected (not shown) between two of the electrical contact 123 leaf members 121, for example, as is generally shown in FIG. 12 taken with FIG. 26.

FIG. 14 shows an electrically connected varistor 54, a subcombination switching means 25 or the lamp socket 33 which has a cherry or micro and the like type of 2-position switching means 47 serially connected with a 4-position clockwise and counterclockwise rotating no electrical "off" switching means 50 which is electrically connected to four separate single filament 130 lamps 9 or 103, when the lamps 9, 103 and the like are inserted into four separate lamp socket members 8 or 33, shown in FIG. 1 and 7 respectively. The wire 44 means is shown electrically connected from one end of the filaments to the 115 VAC source of electric current.

FIG. 15 shows substantially the electrical circuit diagram of FIG. 14 but additionally having a rotary clockwise and counterclockwise 5-position switch means 50' which is shown in its electrical "off" position. Further yet, the subcombination means 48 or 49 has a diode rectifying means 52 electrically connected between two electrical terminals 70, as shown in FIG. 4, for example, of switch means 47. The rectifying means 52 is also shown housed on a Buss Diode Device 37 which is shown in dash-line outline and shown in FIGS. 27, 28 and 29, for example. Thereby as is a buss fuse soldered or link member, the axial leads of rectifying means 52 would be electrically connected directly to the metal end caps 127 of the device 37 which is shown in dashed-line outline. Thereby the two end caps 127 are electrically connected substantially directly to the switch 47 by means of two separate parts of substantially the wire 43 as is shown by the dashed-line outline.

In FIG. 15 the rotary 25 type of snap action switch 50' is shown in its conventional electrical "off" position whereby at least one of the four or even more lamps 9 and/or 103 may be individually illuminated in a rectified half-wave "dim" illumination by use of the rectifying means 52 or be full "on" by by-passing the rectifying means 52 as shown the dashed line outline moved position of the switch member 119. The wire 44 is shown completing the electrical circuit from the single filaments 130 of lamp 9 or 103 to the 115 VAC source of electrical current.

FIG. 16 shows a variator 54 means electrically connected substantially shuntingly, to the wires 43 and 44 but here the varistor 54 is housed in an electric cord varistor 54 device 55 which is shown in FIG. 36, for example. The device 55 having two separate pointed members 134 and 135. The conventional pointed members 134 and 135 are of the type used in, for example, electric cord feed-thru wheel type of switching means, for example, of the type shown and disclosed in FIGS. 7 and 37. Thereby the device 55 will be separated in two parts, 131 and 132, as is switch 56 or 57 of FIG. 7, for example, then the two parts 131 and 132 are reassembled and pressed firmly in place on the electric cord member 133 so that the pointed ends 134 and 135 will pierce the insulation 15 and 15' of the wires 43 and 44 and then make electrical contact in a conventional way, with the wires 43 and 44, as is substantially shown in FIG. 16. The conventional threaded screw 157 as shown in FIG. 36, having a threaded nut (not shown) are then reassembled into the device 55 for firmly securing the two halves 131 and 132 together, as is conventionally done with the wheel-type 56 or 57 electric cord switching means, shown in FIGS. 7 and 37. The screw 157 may also be a rivet 129 whereby the device could be attached to the cord 133 prior to its assembly to any electric incandescent lamp fixture means, television, radio, electronic equipment, computers, or other electrical cord 133 using electrical 15 VAC devices, as desired. The screws 157 or rivets 129 may also be used diagonally or in the two shown locations of the device, instead of the shown center location, as is generally conventionally done and shown in the FIG. 37 of rivet 129, for example, which may be in one location only, if so desired.

FIG. 16 further shows the semiconductor thyristor 136 controlled variable lamp 100 dimming device 45 or 45' which is substantially disclosed in my copending applications Ser. No. 240,605 filed Apr. 3, 1972 and Ser. No. 25,994 filed Apr. 6, 1970.

The device 45 or 45' shows the electrically connected thyristor 136 having three terminals 137, 138 and 139. Also shown are capacitors 140, iron choke coil 141, potentiometer 144, resistor 142, potentiometer rotating rod-like members 18, knob 4 mounted on member 18 and the knob 4 rotating 13, and axially pulled out dashed line position 20 for actuating the switch means 47 or the device 45 by-passing switch means 143 being substantially switch 47' in that it is a by-passing switch 143 and the other switch is a non by-passing switch 47, accordingly. The switch means 47 may be eliminated, if so desired, and even the by-passing switch means 47' or 143 may also be eliminated, if so desired. Rotation 13 of member 18 and axially pulling it out 20, as is shown in dashed line outline and also shown in FIG. 1, will rotate the potentiometer 144 into various "dim" and full "on" electric lamp 9, 100 and 103 illuminating states and yet at any potentiometer setting the knob 4 and/or member 18 may be axially pulled out for passing a half-wave dimmed or rectified portion of electric current to any of the filaments 101, 102 or 101 and 102, or even 130 of lamps 100, 103 and/or 9 respectively, and the by-passing switch 119 means 143 or 47' may also be axially 14 pulled out to its position 20, as desired, for by-passing the switch means 47 along with the entire device 45, especially in the event of a malfunction of the device 45, and removal for repair thereof is required. Thereby the by-passing switch means 143 is also desired, in at least one embodiment of FIG. 16 electrical circuit, and it is also desired to have the by-passing switch means 143 separated from the device 45 and be actuated separately by a push-push or rotating 13 member 18 or rotating 13 knob 4 means as also is shown in FIGS. 1 and 7, for example. The dashed line 146, indicates one outer end portion of the variable dimmer device 45, if so desired. The by-passing switches 48 and 53 that are shown outside of the dashed lines 148, may also be desired to be used in place of the isolated by-passing switch 143 whereby by-passing of the entire device 45 is made possible. Also only the half-wave and less than half-wave rectification of the 115 VAC is now made possible to the shown lamp 100 and/or to from 1 to 20 lamps 9 or 103 shown, for example, in FIGS. 1, 7, 14, 17 and 18 accordingly. The electrical contact member 119 of switch 143, 47 and 48 is also shown in FIGS. 14, 15 and 16.

In FIG. 16 when the upper switch 47 is closed and the by-passing switch 143 is open, and when the subcombination means 48 which is separated as indicated by the dashed line 148 from the device 45, or the subcombination means 53 which was also disclosed in FIG. 15, has its switch contact member 119 in its shown open position, then the variable dimmer means 45 is capable of passing only a half-wave rectified and less portion of the 115 VAC of electric current to the filaments 101 or 102, or 101 and 102, or to any number of Christmas tree lamps 9 (not shown) or to any number of lamps 9 and/or 103 as shown in FIGS. 1, 7, 14, 17 and 18, for example. When the upper switch 47 is closed and when the subcombination means 48 or even subcombination means 53 has its manually actuated contact member 119 in its closed dashed line 119' shown position, then the variable means 45 may pass a variable rectified portion, above the rectifying capability of the half-wave 52, of the 115 VAC of electric current supply to the Christmas tree; incandescent lamp fixture means 1; 90 and/or even the electric cord 133 plug-in clock timer lamp dimming device 250; the plug-in clock timer dimming device 251; the electric cord plug-in photoelectric lamp dimming device 252 or even a non-electric cord plug-in photoelectric lamp dimming device 251 as is the device 251 of FIG. 34 and/or even the photoelectric lamp dimming electric socket adapter device 253 and 254 as is desired, and which are shown respectively in FIGS. 31 to 35. The variable dimmer means 45 or 45' or the subcombination means 48, 48' or 53 may be alone in the above devices 250, 251, 252 and 253, as is desired for accordingly obtaining at least one of the disclosed objects.

In FIG. 16, the disclosed variable 45 or 45' and/or half-wave diode rectifying means 52 is shown selectively electrically connected by using a 3-way switching means 51 having a conventional 3-way lamp socket 108, which is generally shown in FIG. 25, for example, to a 3-way incandescent lamp's 100 filaments 102 and 102. Thereby, the low wattage filament 101 or the high wattage filament 101, or both of the filaments 101 and 102 are selectively susceptible to be an infinitely variable; half-wave and/or variable and half-wave dimmed illumination, as desired. Thereby, the life use of a 3-way lamp may be extended to a maximum of 60 times of the orginal life illuminated use thereof and generally a maximum of 30 times its life use when both of the filaments 101 and 102 are in constant switching use of "dim" and "off" when using the half-wave rectifying means 52 only and generally 30 and 50 times its life use when using the rectifying means 52 and the variable dimming means 45 accordingly, as desired. The wire means 44 is shown completing the electrical circuit to the 115 VAC electric current source of supply, when the lamp 100 is inserted into a conventional 3-way lamp socket 108, shown by arrow means, and generally shown in FIGS. 7, 21, 23, 25 and 38. The electrical current diagram, shown in FIG. 16, or any portion of thereof, may be used in the fixture portion of the electric incandescent lamp combination fixture device 1 which is shown, for example, in FIGS. 1 to 7 of the tubular and/or chain 23 or swag chain 23, shown fragmentarily, for example, in FIG. 7. The electric circuit diagram of FIG. 16 or any portion thereof may also be used in a 3-way lamp socket 108 having a convention 3-way lamp 100 selectively switching means 51 as is substantially shown in FIGS. 7, 9, 16, 21, 23 and 25, for example.

Figure 17:
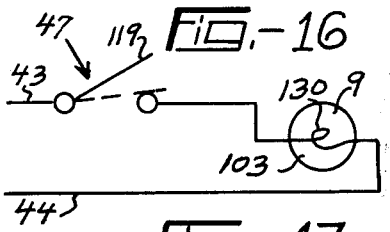
FIG. 17 is another alternative, as desired fragmentary electric-schematic circuit diagram of still another selectively switching and incandescent lamp means usable in the present combination fixture device.

FIG. 17 shows an alternate portion of the FIG. 16 electrical circuit diagram in that the FIG. 16 2-position switching means 47 is the same as in FIG. 16 but not having substantially the subcombination means 37, 48, 143, 53 and end caps 127 and not having the 3-way lamp socket 108 or the 3-way lamp socket switching means 51 or the 3-way lamp 100. Thereby the FIG. 17 would have all of that which is shown in FIG. 16 up and including the lower outer switching means 47 and a single filament 130 lamp 9 or 103 which is shown in FIG. 17. The electrical wires 43 and 44 are also shown are completing the electrical circuit from and back to the 115 VAC electric current source. The simplified electrical circuit is substantially used in the FIG. 7 electrical fixture portion of the combination fixture device 90. The dimmer means 45 or 45' would be housed in the rectangular shaped housing 88 of FIG. 7 or be housed and mounted with screws 112 on the support member 92 as is switch 25 or be secured by the screws 112 or nut 5 to the inside of the dome 99 while having the knob 93 or knob 4 rotatable 13 and axially movable 14, according as desired, to at least the dashed line 20 position, which is generally shown in FIG. 7. The switch 47 shown in FIG. 17 may also be eliminated, as well as the non-by-passing switch 47 shown housed in the dimmer means 45, if so desired, leaving only the by-passing switch means 143 in the electrical circuit as disclosed in FIg. 16, for example.

FIG. 18 also shows a fragment portion of an alternative latter portion of the FIG. 16 circuit, that replaces the subcombination means 48 along with the buss diode device 127 and all other attached members to the wire 44 means along with the 3-way switch 51 and socket 108 and the 3-lamp 100. Thereby the FIG. 18 non-"off" 2-way switching means 25 and the 6 lamps, for example, 9 along the lamp sockets 8, shown in FIG. 1 are to be added to the dimmer means 45 electrical circuit, whereby the switching means 143 to either still be therein or be eliminated, as desired. Thereby, the now FIG. 18 variable lamp 9 dimming means 45 and 45' will either variably dim only 3 of the lamps 9 of the hung tubular 21 of FIG. 1 and/or swag chain 23 of FIG. 7, chandelier's lamps 9, when the nonoff electric selectively switching means 25 is in its shown position 140 and when it is in its dashed line position 141, then all 6 of the lamps 9 may be variably dimmed accordingly, or be fully illuminated. Also only three lamps 9 could be in their "on" electrical state or be fully illuminated. Also all 6 of the lamps 9 could be in their "on" non-rectifying electrical state, as desired, accordingly.

In the FIG. 18 preferred chain 23, of FIG. 7, hung fixture device embodiment, a center lamp 9 (not shown) could be electrically connected by the switch 25 means only to the first contact for variably dimming only the center lamp 9. Clockwise rotation of the switch 25 would then electrically connect all 6 lamps 9 into the electrical circuit, whereby all 7 lamps 9 would be variably dimmed, as desired, or the center lamp 9 and then the other 6 lamps would all be fully "on" as desired.

FIG. 19 shows an electrical circuit having the 115 VAC, wire 43 electrically connected to the subcombination means 48 having the rotating 117 switch means 47 which has the rectifying means 52 electrically connected thereto. The FIG. 18 feed-thru wheel 35 or 35' type of electric cord switching means 56, shown respectively in FIGS. 7 and 37, is shown electrically connected and mounted on an electric twin conductor 43 and 44 cord member 133, as indicated by the dashed line outline 142 of the electric cord, diode 52 rectifying switching means 56. The switching "dim" and "on" means 56 is shown electrically connected serially, if so desired, with a conventional electric cord switching "off-on" means 58 shown in dashed line outline which is conventionally presently mounted on electric twin cord members 133 shown in dashed line outline which control the "off-on" illumination to one filament 130 of lamp 9 and/or 103 of a conventional chain or even the swag chain 23 hund combination fixtures devices 1 and/or 90; as well as table lamps, bed lamps, Christmas tree lamps 9 and the like having at least one filament therein, for example, as in the incandescent lamps 9 and/or 103. The wire 44 is shown electrically connected for completing the electrical circuit substantially back to the 115 VAC source of electric current.

FIG. 20 is substantially the same electric circuit diagram of that disclosed in FIG. 19 except that in FIG. 20 the conventional "off-on" electric cord switching means 58 of FIG. 19 is not used or needed in FIG. 20's electrical circuit since the two rotating contacting members 128 of switch 34, having the half-wave rectifying means 52 electrically connected substantially to and between two of the three electrical switching contacts (not numbered) for providing three electrical conditions or illuminations for the lamp's 9 filament 130, and being an electrical "off", "dim half-wave rectified", and an "on" selective switching positions when the wheel 35 of FIG. 7, or the wheel 35' of FIG. 37 is manually rotated clockwise. FIG. 20 shows the improved electric cord switching means 57 also conventionally mounted 142 shown in dashed line outline on the twin electrical conductor member 133, having the insulated 15 and 15' wires 43 and 44 therein. Thereby, a string of Christmas tree lamps 9 (not shown) as were the lamps 9 of FIGS. 1, 7, 9, 10, 14, 15, 16, 18 and the like, are also to be electrically controlled, as desired, as well as table, floor, bed and the like incandescent lamp fixtures having the incandescent lamps 9, 100 and/or 103 therein. And even by the use of the 3-position improved electric cord half-wave switching means 57, as well as by the use of the improved 3-way lamp socket 50 and even the FIG. 25 improved half-wave diode 52 electric switching means 33, for example, in the floor, table bed and the like lamp fixtures.

FIG. 21 shows a, for example, micro or cherry type of two position switching means 47 mounted on a side wall 148 insulated portion of a Levolier type of electric selective switching means 144. The shown Levolier switching means 144 being for a 2-position Levolier lamp socket 33 means of the switch member 117 rotating type as shown, for example, in FIGS. 7 and 11, and also for a 3-way selectively switching means 51 of a 3-way Levolier lamp socket means 108. Two threaded screws 112 are threaded traversly into the insulation material, side wall 148 for removably securing the housing 145 of the switching means 47 to the side wall 148. The switch means 47 having three conventional electrical terminals 70. The half-wave diode rectifying means 52 is shown with its two axial leads 149 electrically connected by being soldered 166 to the two outside terminals 70. The insulated 15 electrical wire 43 is soldered directly to the upper terminal 70 and one end of a short piece of, for example, wire 43 is then soldered to the lower terminal 70 and the other wire 43 end may be either soldered to the lamp socket terminal 150 or be mechanically secured under the head of the threaded conventional screw 151 and against an elongated surface portion of the lamp socket terminal 150. An alternate, dashed line outline, means for removably securing the lead in wire 43 to a washer 154 and under the head of a threaded screw 153 is also shown. Thereby one end of a short piece of, for example, wire 43 shown in dashed line outline, would be originally soldered 166 by a manufacturer, if desired, to the washer 154 and the other end of the short wire 43 would be soldered 166 to the terminal 70 along with the end of the axial lead of rectifying means 52. Thereby, a person who is electrically connecting the dashed line lead in insulated 15 wire 43, would only have to secure the end of the wire 43 between the washer 154, which is preferred to be non-rotating, and the underside of the head of the screw 153, in the conventional manner, since the rest of the electrical shown connections would be originally made by a person or mfg. of the improved half-wave dimming "Levoilier Diode Lamp Socket Dimming Device" of the 2-position type for a single filament 130 of lamp 9 and 103, and for a two filament (101 and 102) 3-way switching means 51 of a 3-way lamp 100 that is shown respectively, for example, in FIGS. 1, 7 and 19 for the single filament 130 of lamp 9 and 103. And, for example, as is shown in FIGS. 7, 9 and 16 for the two filaments 101 and 102 of the 3-way lamp 100. The lamp 9, 100 or 103 receptable portion 152 is also fragmentarily shown.

In the FIG. 21 the Levolier conventional switch 144 portion being for either one or both of the single filament lamps 9 and/or 103, and the 3-way lamps 100. A partial counterclockwise rotation of the counterbored 366 knob 17 will force the arm 147 upwardly. Thereby, the switch 47 button 61 is forced into and also be allowed to come out of the switch 47 housing 145 to its initial (not shown) position. The half-wave "dimming" of the filament 130 of a, for example, lamp 9, and half-wave dimming of any one of the filaments 101 or 102, or both of the filaments 101 and 102 of a 3-way lamp 100, is thereby obtained as desired, when the end 158 of arm 147 is in its shown forced up position, by the end 160 of arm 159. When the knob 17 is rotated clockwise from the FIG. 22 shown raised 168 arm 159 end 160 detenting 167 position to its resting position 169 shown in FIG. 22, then the end 158 of arm 147 is released downwardly to its shown initial rest dashed line position 170. Thereby, the switch 47 is released to its initial closed position for by-passing the rectifying means 52 whereby any filament 130, 101, 102 or 101 and 102, respectively of lamps 9 and/or 103 or lamp 100 will be in their initial non-dimmed full "on" electrical illuminating state. It should be noted that the knob 17 may be rotated as disclosed regardless of how the knob 4 is universally actuated directly by hand or indirectly actuated universally or in the up and down 14 position through use of the pull chain member 40 having the conventional pull chain member 40 end pull member 42 which is shown in its pulled down dashed line position 42'. The end 158 of arm 147 has a, for example, coined grooved 167 into which the corner 471 portion of the arm 159 end 160 detents. Also a formed or coined downwardly, towards the knob 4, portion of the end 158 member would also be equally as effective for providing a detenting projection over which the corner 471 must detents, accordingly, as desired.

It should be noted that, depending on the amount of over-center counterclockwise rotation of the knob 17 and corner 471, that no detenting means whatsoever would be required, if so desired, since the end 158 taken with a generally firm return spring action of the button 61, would inherently cause a downward spring action against the over-center position of the corner 171. An opening 171 is inserted traversely through the wall of member 176 so that the improved "Levolier Incandescent Lamp Socket Dimming Device" or switching means 144 would fit substantially into a conventional, for example plastic lamp socket means 155, shown in fragment or cross-section and so that the end 158 will be inserted into the path of the rotating end 160 of arm 159. The arm 159 is an integral portion of the knob 17 or is made an integral part of the captive tubular-like bushing member 172 which is an integral portion of the knob 17. Both ends of the bushing member 172 are freely captively retained between the end top surface 174 of the U-shaped conventional member 163 and the shoulder 173 of the substantially conventional riveted bushing 164. A small groove 156 was required to be made in the upper plastic portion of the lamp socket member 155, to provide clearance for the arm 159. The tubular 172 portion of the knob 17 is cut away so that a better understanding of the FIG. 21 construction is provided for persons skilled in the art. Two conventional side ears 146 pivotly support the arm 147 in conventional manner.

FIG. 22 view is substantially taken along line 1—1 of FIG. 21. Shown is a cut-away portion of the knob 17 so that a clear showing of the front view of the improved portion of the switching means 144 is provided. The FIG. 22 view shows the other conventional terminal 174 and its other conventional threaded screw 175 having the insulated 15' wire 44 electrically connected against the terminal 174 by the underside portion of the head of the screw 175. The end 158, of arm 147, is shown extending through the opening 171 are terminating short of the other insulated wall 176 of the switching means 144. An underside corner edge portion of the end 160, of arm 159, is shown bearing against an outer top surface 177 of the U-shaped bracket member 163, whereby a counterclockwise stop means is automatically created for the knob 17. When clockwise rotation of the knob 17, arm 159 and end 160 is made, then an underside portion of the off-center cam-like arm 159 end 160 will also be stopped against another outer surface portion of the same top edge 177 of the U-shaped bracket member 163, for now automatically providing a clockwise stop means for the knob 17 and end 160 accordingly. The clockwise stopped position of end 160 is shown in dashed line outline 169 and thereby substantially having the end 158 shown in dashed lined outline, resting against substantially a top outer edge portion of the end 160. A fragment portion of the pull-chain member 40 is also shown exiting from a conventional pull-chain opening in the end of the universally actuating knob 4.

FIG. 23 shows a lower fragmentary portion of a Levolier type of switching means which, for example, may be a 2-position 47, or a 3-position 34 or a 4-position 51, as desired, as is respectively shown in FIGS. 11, 10 and 9. All the above, for example, are of the rotating electrical contacting type substantially as is shown in FIG. 25 but are of the Levolier universally actuating knob 4 type. FIG. 23 shows the upper portion of a threaded, Levolier, firmly staken bushing 178. An opening 181 is formed in the bushing 178 for forming one stop ear 196 and the two ears 182 so that the spring 161 will be shouldered in place for returning the knob 4 to its initial state and for automatically forming spring 161 detent action when the raised detent portion 200 of knob 16 is engaged in either of the two grooves 190 in an end of the bushing 178. A jam nut 179, against the wall 180 portion of lamp fixture 1, and another jam nut 5 is shown. When the knob 16 is rotated as shown, counterclockwise, then the cherry switch's arm 184 is released to its normal closed position so that the rectifying means 52, which is more fully seen electrically connected in FIG. 21 and thereby by-passing the rectifying means or diode 52 and a full "on" illumination of any lamp 9, 100 or 103 will be obtained. The above position is fully illustrated in FIG. 24. When the knob 16 is manually rotated clockwise, then the detent 200 is engaged into the right sided detent 199 and the ear 183, a bushing portion of knob 16, will force the arm 184 to the right and substantially against the inside of the wall 201, as is shown in dashed line outline 184' in FIG. 24 whereby the arm's 184 moved position 184' will force the switch 47 actuation button 61 into its switch 47 open position, as is generally shown in FIG. 25. Thereby the diode 52 will be switched into the electrical circuit for now half-wave dimming any lamp or lamps 9, 100 and/or 103, as desired. The top 196 of the formed in projection or ear 203 will act as a stop against the edge 195 of ear 183 in one rotational direction and in the other or clockwise rotation the ear 202, shown in FIG. 24, could also be stopped against the other side, not shown, of ear 203, if so desired. Also one ear 183 only may be used, whereby a side edge of ear 183 would be stopped against the end of the arm 184 which is forced against the stationary inside wall portion 201, as is shown in FIG. 24. The connecting link member 162, of FIG. 23, will automatically also by spring 161 force, pull the knob 4, as shown in FIG. 1, against the knob 16 which is also spring 161 detented into the two grooves 199. The knob 4 will, for example, be universally actuated against an outer conventional circular grooved (not shown) surface. Any number of detents 200 and corresponding grooves 199 may also be used, if desired.

A pull chain member 40 may also be used to actuate the Levolier switch as is generally shown in FIG. 1 if so desired, whereby the knob 4 could be a stationary threaded knob nut 5 on the end of member 178 and in spring loaded spaced relation with the knob 16, if so desired. A curved spring washer, not shown, would be inserted in, for example, the space 204 shown in FIG. 1. The knob nut 5, in FIG. 1, would then be an ornamental nut only.

FIG. 24 shows the opening 181 in the tubing 178 having an end portion of the switch 47 actuating arm 184 therein that is shown in its actuating and non-actuating positions, as was fully disclosed in FIG. 23.

FIG. 25 shows a fragmentary base portion of an improved conventional lamp socket 108 and which also represents a lamp 9 socket 33, since both types of sockets 33 and 108 use the improvements which are here shown and disclosed. The shown improvement was enclosed in a standard outer base and upper shell portion (not shown) of a lamp socket 108, for example.

When a person rotates the knob 4, the substantially conventional bridging contact carrier disc 193 is ratched along with the conventional electrical bridging contact members 117 in a conventional way accordingly as desired. Thereby, for example, a 2-filament 3-way lamp will be switched into an "off" and a half-wave "low-dim", "medium-dim" or "high-dim" positions as desired. The half-wave dimming of the 3-way lamp was effected or accomplished because the end 114 of the rod-like member 18 had been operatively manually axially pushed into its shown detented position and thereby the, for example, cherry switch 47 arm 184 forced the switch 47 actuating button 61 into the switch 47. Thereby, the switch contacts separated into an open position, as is generally shown in FIG. 9, and the diode 52 was electrically connected directly into the electrical circuit to the 3-way switch 51 and lamp 100 filaments 102 or 101, or 102 and 101, respectively, as is shown in FIG. 9.

Now, when the knob 4 is operatively manually axially pulled out to its dashed line position 20, then the end 114 releases the arm 184 to its dashed line rest position 170 which is conventionally created by internal spring action against the button 61 which in turn, forces the arm 184 to its rest 170 position. The switch 47 is now in its closed "on" position and thereby by-passes the diode 52, as is generally shown in FIG. 9 by the solid line contact member's 119 moved dashed line 47' position of the switch 47. When, if so desired, the axial lead 149 and the electrical lead-in conducting wire 43 is electrically connected to the center terminal of the switch 47, as is shown by the dashed line outline 206, then the above "dimming", "on" and axial movement of the end 114 and knob 4 will be the bring opposite results, according. It should be noted that the knob 4 may be axially moved at any desired time regardless of the rotary position of the contacts 117 and the disc 193. Thereby, the 8 combinations of 3-illuminations fron one 3-way lamp is made possible, as disclosed in the objects.

In FIG. 25 further shows an improved disc 193 which is made of an insulating material and having a slot 205 traversely through the disc so that the swedged out portion 186 may move axially therein. The spacer 187 spaces the disc 193 to one side of the conventional opening and against an insulating inner wall 188' portion 188 of the lamp socket so that axial end play of the disc 193 is at a desired limiation or dimension. The spacer 187 has a thin wall member having an end 197 portion thereof for detenting action into the two circular grooves 198, if so desired. The disc 193 may also be used without the spacer 187 when the hair pin spring 209 is confined sideways in a slot 208 of the spring 209 housing 192. A lower detenting portion 191 of the spring 209 is detented into the two circular grooves 207 when the stem or rod-like member 18 and knob 4 is axially moved to the dashed line position 20 and moved back to its initial shown position to prevent accidental axial movement of knob 4 when it is manually rotated and to retain the end 114 in its shown forward position against the conventional spring return action of the switch 47 arm 184, also when the knob 4 is rotated. Only one circular groove 207 will be required when the substantially hair pin spring 209 type is used but the slot 208 would have to be of the outer shape of an upside down capital vee. Both detenting means 197 and 191 may be used at the same time, if so desired. Two switch 47 mounting holes 85, two stem or rod-like member 18 support insulating material members 189 and a portion of a conventional insulating lamp center contact supporting disc member 192 for also retaining the spring housing 194 in place is also shown. The rod-like member 18 grooves 207 may be detentingly located between the upper 210 and lower 191 members of the spring 209 whereby a hole or slot (not shown) would be inserted traversely to the slot 208 in a longer length bottom portion of the housing 192, if so desired, whereby the new hair spring detenting action is still preserved.

FIG. 26 shows a less desired alternate switching means 120 for the switching means 47 of FIG. 25, if so desired. The switching means 120 having three leaf 121 contacts 123 insulatingly separated and secured to spacers 122, in a conventional way (not fully shown). Two leafs 121 and two contacts 123 may also be used as an alternate for the switch 47 means shown in FIG. 26 since two axial positions of the end 144 is also shown. In FIG. 26 three axial moving positions would be required, as is generally shown of knob 4 and 94 in FIG. 7, for example. The initial and the 20 and 20' positions of end 114 are also shown. Persons skilled in the art will know how the FIG. 26 switch is to operate and how to mount and electrically hook up the switch 120 and insert an additional groove 198 or 207 in the member 18 shown in FIG. 25, having this application before then. Also the use of an additional cherry switch 47 to the FIG. 25 embodiment so that the two "axial" 14 positions 20 and 20' of the end 114 is fully used for having the electrical circuit which is shown substantially in FIG. 10 but wherein two rotating switching means 34 and 50 are used. The actuation of arm 184 in FIG. 25 could be used to actuate a second arm 184 of the second switch 47 or to progressively actuate two buttons 61, (not shown) one at a time, by using only one special shaped arm 147, shown in FIG. 21 and 22, as desired, for another FIG. 10 embodiment that is substantially shown in FIGS. 7 and 12 as switch 25, taken with the switch 50 of FIG. 10 for example.

FIG. 27 shows a "buss diode cartridge" combination device 53 having a buss fuse outer cartridge portion 37 having the conventional glass center elongated tubular member 211 and two conventional end cap members 27 capingly mounted on each of the two outer open ends of member 211. Two preferred, silicon diode half-wave rectifying means or diodes 52 having their axial leads 149 electrically connected or soldered, as is a strip of buss fuse material, to the inside end wall portions (not shown) of the end caps 27. The FIG. 27 embodiment may also have one diode 52, if so desired, and room permitting, as is shown in FIG. 29. The two diodes 52 are preferred to be a matched pair so that electric current will pass substantially equally through them to a desired electrical load source which is to be half-wave rectified. The device 53 is thereby equally as easily to be inserted or changed, when, for example, the diode or diodes 52 malfunction, as is a buss fuse cartridge.

FIG. 28 shows another embodiment of a "buss-diode cartridge combination device" 53 being different from the FIG. 27 embodiment in that the elongated tubular center member 212 is not a glass material and is air permeable by means of at least one hole 231 therein. The, for example, three holes 213 allow heat from at least one diode 52 to escape through the openings 213, substantially allowing air to circulate around the diode 52, and then escape through the opening 213 of openings 213 after it has absorbed some of the heat which may be created by the diode 52 as it rectifies electric current. The tubular member 212 is to be nade of a suitable electrical non-conducting or insulating material. The holes 213 may be eliminated, if so desired, when the insulating material is or is made to be air permeable.

FIG. 29 shows substantially the same embodiment of a buss diode cartridge combination device 53, as that which was shown and disclosed in FIG. 27, with the exception that only one diode 52 is housed in the conventional glass elongated tubular member 211 and the end caps 214 have at least one opening 217 therein for providing at least one heat escaping means from the inside of the device 53. A large capacity diode 52 may require more than one opening 217 whereby two openings 217 through each end wall portion leaving a narrow strap-like member 216 at each end for electrical connection or soldering 215 of the two ends of the axial leads 149, accordingly. Circulation of air through the device 53 is shown by arrow means 218 going into one end and exiting out of the other end. The end caps 214 are preferred to be identical for ease of manufacturing, assembly and less cost thereby.

FIG. 30 shows a subcombination means 48 for example, having a micro type of electric selectively switching means 47 having a switch actuating button 61 and also having three electrical terminals 70 with a half-wave diode rectifying means 52 electrically connected to and between two outside terminals 70. The end 114 of the rod-like member 18, shown in FIG. 26 and herein FIG. 30, has an electrical insulating material 115 mounted on its outer end. The material 115 is not required in the FIG. 30 embodiment but it is required in the FIG. 26 embodiment so that electrical current will not be passed to the end 114 and to the rod-like member 18, for safety reasons and, for example, "UL" approval. The end 115, in FIG. 30 may be eliminated, as it is in FIG. 25 if so desired. The FIG. 30 switch 47 may be used substantially side by side with the switch 47 of FIG. 25 and the arm 184 could have a right angled portion thereof, as substantially is the end 158 which is shown in FIGS. 21 and 22, so that the arm 184 is now substantially arm 147 having substantially an end 158 thereon. Thereby the end 158 of arm 147 would now actuate the button 61 of switch 47, of FIG. 30, and the switch 47 with the diode 52, shown in FIG. 25, would also be actuated by the arm 147 when the arm 147 is forced twistingly to its shown, for example, position in FIG. 25, and when a third groove, for example, 207 is added to the shown two grooves 207. Now, when the center and lower terminals 70 of both switches 47 are electrically connected and when the end 114 is axially moved back to its 20 dashed line position, shown for example in FIG. 26, at least one lamp 9, 100 and/or 103 will be illuminated from its "on" illumination to its "dim" half-wave illumination. And when end 114 is axially moved back to its 20' position, shown in FIG. 26, none of the lamps will be illuminated, regardless of how the knob is rotated, when using the 3-position switching "no-off" means 50 which is shown in FIG. 10.

The FIG. 30 arrangement with or without the end 115, may also be used to replace the FIG. 25 arrangement of the switch 47 with the arm 184, if so desired. Thereby, the arm 184 is the only member that is eliminated.

FIG. 31 shows an electrical circuit of an electric lamp 9, 100 or 103 dimming and appliance timer shown by arrow means 250 in the small dashed line outline. The lamp and appliance timer 250 is one of conventional construction and design, substantially as is the plug-in electric lamp and appliance timer 251 which is shown in FIG. 34 except that the electric lamp and appliance timer 250 is of the type having a twin electrical conductor cord member 133 electrically connected thereto. The cord member 133 having two electric conducting wires 43 and 44 electrically connected to the electric circuit of the timer 250 and having on the other end of the wires 43 and 44 and cord 133 an electric plug-in member 110, shown in FIG. 37, having two male prongs 219 and 220 which are to be suitably electrically connected into an electrical outlet receptable, now shown. The end of the wires 43 and 44 are secured or electrically connected to one end of the prongs 219 and 220, as desired.

In FIG. 31, when the prongs 219 and 220 are electrically connected to a 115 VAC source of electric current and an electric cord plug-in plug of an electric incandescent lamp fixture having at least one lamp 9, 100 or 103 electrically connected thereto, then the timer 250 is in operation for either illuminating at least one of the lamps into a full "on" or half-wave "dim", manual or automatically timed illumination. For an "on" illumination when, for example, the rocker 229 type of switch 47 actuation means is in its up 24 shown position, then the electric current passes, for example, through the prong 219, through the wire 43 to the small conventional synchronous motor 221 and its conventional tripping and electric switching "on" and "off" mechanism 222, to the subcombination means 48 switch 47, through the dashed line 119' closed switch position, by-passing the diode 52, to the controlled electric outlet receptacle 225, to and through the not shown lamp 9, 100 or 103, substantially back through the electric outlet receptacle 226, through the wire 44 substantially to one side of the motor 221 while passing on to the prong 220 and to the other side of the 115 VAC source of electric current. Now when the rocker 229 is operatively manually rocked to its dashed line up 24' position, the switch 47 is actuated to its up 119 open position for switching the diode 52 directly into the electrical circuit, whereby at least one lamp 9, 100 or 103, not shown, is now in its half-wave "dim" illumination. The subcombination means 53 is very desired and is to be used in the electrical circuit of the timer 250, as is shown by the dashed line outline by arrow means 49. The electric current would then pass substantially from one side of the switch 47 to one, see FIGS. 27 to 29, end cap 127, through the diode 52, through the second end cap 127, bridgingly to the other side of the switch 47. A suitable buss fuse cartridge clip-in, in-line fuseholders, panel mounting fuse holder, and the like means is shown by the dashed line fragmentary outline 230. The electric current would then substantially pass from one side of the switch 47 to and through one end of, for example, the buss fuse clip to one end cap 127 through the diode 52, through the other end cap 27, through the other end of the buss fuse clip and bridgingly back to the other side of the switch 47. A 3-position "off", half-wave "on-dim" and full wave "on" electric selective switching means 34 or 25 being subcombination means 48', as is respectively shown in FIGS. 10 and 12, are to also be used in place of the subcombination means 48 of the timer 250, accordingly, as desired. Thereby at least one lamps 9, 100 or 103, or the motor 221 and/or an outside plugged into the timer 250, motor or appliance, will also be turned "off", as desired, even though the timer is plugged into the 115 VAC source of electric current.

FIG. 31 also shows a plug-in electric lamp 9, 100 or 103 dimming and appliance timer 251, in dashed line outline entirely around the timer 250 to indicate that the timer 251 is of the plug-in type, as is shown in FIG. 34. Thereby the electric cord 133 and the plug-in housing 110 for the prongs 219 and 220 are not used with the plug-in timer 251 type which is shown in FIG. 34, for example. But the entire electrical circuit and all various disclosed variations and the like are to be incorporated into the timer 251, including the electrical circuit and components of the FIG. 32 disclosure and showing are all to be used, accordingly as desired, in the FIG. 34 plug-in timer 251.

FIG. 32 shows only a fragmentary latter portion of another electrical circuit having a lamp 9, 100 or 103 variable dimming means 45 or 45' therein taken with the FIG. 32 forward portion of the electrical circuit from the subcombination means 48 and 48' back to the 115 VAC source of electric current of the timers 250 and 251, as desired, and thereby becomes an electric incandescent lamp 9, 100 or 103, variable dimming and appliance timer.

Electric current will now pass substantially from the mechanism 222 through the wire 43 of FIG. 31, and now glancing to FIG. 32, to and through the variable incandescent lamp dimmer means 45 or 45', to the variable dimmer means 45 or 45' controlled electrical outlet receptacle 225 and substantially to and through at least one lamp 9, 100 or 103 and back through wire 44 to, now see FIG. 31, the motor 221 and the 115 VAC source of electric current. The knob 4 is rotated 13 for variably dimming the disclosed lamps 9, 100 or 103 as desired. The knob 4 is operatively manually axially 14 moved 20 for actuating the switch 47 to its dashed closed line position 119' for by-passing the dimmer means 45 portion of the dimmer means 45' as indicated by arrow means. It is also to be noted that rotation 13 of the knob 4 is to be used in other embodiments of the timer 231 for operatively manually and rotatingly actuating the switch 47 to its 119 and 119' shown positions. Thereby the axial 14 moving 20 operations disclosed hereabove could be eliminated or used for axially 14 actuating a second switch 47 for an "on-off" switching operation, as was disclosed in the latter portion, hereabove, of FIG. 31.

FIG. 33 shows a photoelectric incandescent lamp 9, 100 or 103, not shown, dimming device 252 having an electric cord member 133. The available light or lack of it is indicated by the double arrow means as being the method used for conventionally selectively switching the 115 VAC source of electric current within the 241 portion of the photoelectric device 252 into an "on-off" condition or position substantially to the photoelectric controlled electric outlet receptacle 225.

The FIG. 33 electrical circuit, taken with the disclosure in FIG. 31 regarding plugging into the 115 VAC source of electric current and plugging into the two electrical outlet receptacles 225 and 226, of an electric plug 110, for example, of an incandescent lamp fixture means having at least one lamp 9, 100 or 103 therein, is generally as follows, when there is lack of a proper amount of light.

A source of alternating electric current passes through the male electrical plug-in prong 219 through the electric conducting wire 43 to one side of the clockwise closed 239 switch arm 238 of the photoelectric device's switch 241. Some electric current passes through a fine metal wire 240 which is insulatingly wound around the arm 238 with one end of the wire 240 being electrically connected to the upper end of the arm 238 while the other end of the wire is electrically connected to the 243 end of the photocell 232. The other end of the photocell is electrically connected to one end of an electrical conducting wire 242 which has its other end electrically connected to the electric conducting wire 44 allowing the electric current to pass back to the other male electrical plug-in prong 220 and back to the 115 VAC source of electric current, so that some electrical warming up or heating, by means of the fine wound wire 240 therearound, of the arm 238 is obtained, which heating of the arm 238 is a prerequisite for proper operation of the photoelectric lamp dimming device 252. Electric current continues to pass through the arm 238 which is shown in its closed position 239 to and through the switch 47 position 119' which is shown in its closed dashed line position and then the electric current continues to pass to the controlled electric outlet receptacle 225 and substantially to and at least one lamp 9, 100 or 103 (not shown here) and back to the 115 VAC source of electric current. Thereby at least one lamp 9, 100 or 103 will be in an "on" illuminated electric state. When the button 235 of the slide switch 47 is operatively manually moved to its dashed line position 236, then switch 47 is in its open 119 position so that the electric current will now pass through the diode 52 wherein the current is now half-wave rectified for half-wave dimming at least one lamp 9, 100 or 103. The disclosed and shown subcombination means 48 may also additionally be a subcombination means 48' which has a three position switch 25 or 34 as is shown in FIGS. 12 and 20, for example. Thereby the "off" position of the switch 25 or 34 would be used for switching "off" the electric current to the switch 241 whereby the current will be switched "off" to the fine wire 240 and photocell 232 as well as to the controlled receptacle 225 and any lamp 9, 100 or 103 accordingly.

Accordingly, when the photoelectric cell 232 receives a required amount of light, for example, artificial or available, then electrical current will additionally pass from the cell 232 to the fine wire 240 for heating up the arm 240 further yet, whereby the switch 241 will now be in its shown open position 238 and any lamp 9, 100 or 103 will be automatically switched "off."

In FIG. 33 an "Electric Cord Varistor Device" 54 is shown in dashed line outline 55. The device 55 is shown electrically connected 134 and 135 to and across the wire 43 and 44 while it is mounted on the electric cord 133, shown by arrow means.

A, cordless 133, plug-in photoelectric incandescent lamp dimming device, shown by arrow means 237 and shown in FIG. 34 and by the dashed line lamp dimming device's outline to the prongs 219 and 220 is also to be used substantially as is the plug-in timer shown and disclosed in FIG. 34. The varistor 54 alone, may now be electrically connected inside of the device 237, across the wires 43 and 44 substantially at the 134 and 135 indicated places. The varistor's 54 use and advantages is fully disclosed in the FIG. 36 disclosure. The window 227 of the cell 252 is also shown.

FIG. 34 shows a plug-in incandescent lamp 9, 100 or 103 dimming and appliance timer 251 which is indicated by arrow means. The timer 251 having two electrical male prongs 219, hidden, and 220 which prongs are to connected or plugged into a suitable receptacle of a 115 VAC electric current source, for example, a wall mounted receptacle 111 shown in dashed line outline. Two conventional clock dial 246 time setting pointers 244 and 245 are also shown. The subcombinations 48 and 48' as well as the variable incandescent lamp 9, 100 or 103 (not shown here) dimming device 45 and 45' are also to be used in the FIG. 34 timer 251, as is desired, and disclosed in FIGS. 31 and 32 accordingly. The face of the dial 246 is to have at least one or any desired or conventional time setting scales, not shown. The switch 47 actuating rocker 24 is also shown and which rocker 24 along with the 3-position switches 25 and 34 are also to be used in the FIG. 34 timer 251 as desired and was disclosed in FIG. 31. The knob 4, for rotating 13 and axially 14 actuating any desired switches 25, 34 or 47 as well as the dimmers 45 and 45' is also shown on the top of the timer 251. A portion of the rod-like member 18, having the knob 4 mounted thereon, is also shown. The knob 4's use was fully disclosed in various FIGS. in this disclosure, which knob 4 has or may have different shapes, as desired, or was disclosed. A photoelectric cell 232 having a window 227, may also be used in the timer 250 and 251 type of housing or case 247 if so desired, as was disclosed in FIG. 33. The cell 232 may also be used to start and stop the running of the motor 221, in the daytime, as desired, for at least extending the life use of the motor 221. Also should the motor 221 malfunction, at least the photoelectric cell lamp dimming device of FIG. 33 or 35 would thereby be used.

FIG. 35 shows a photoelectric lamp socket adapter incandescent lamp dimming device 253 which functions the same as does the FIG. 33 device 252 and the FIG. 34 device 251, both having the photoelectric cell unit 232 and the window 227. The double arrows are also shown twice in FIG. 35 and once in the FIG. 34 indicating that the devices 251 and 253 also respond to existing light conditions as does the FIG. 33 device 252.

In FIG. 35 it shows the large base, as compared to the candelabra, small base, of the FIG. 1 lamp 9, for example, and for clarification all lamps 9 and 103 are of the single filament or of the substantially single filament type, in that only one level of illumination is conventionally possible, without some means of rectification.

In FIG. 35 it further shows the large base lamps 9, 100 and 103. The top portion 260 having the receptacle for receiving the base of the lamps 9, 100 or 103 but a receptacle for a small candelabra base bulb may also be adapted for use therein, if so desired. A two position slide switch 47 may also be used with the subcombination 48 for half-wave and full-wave dimming of the lamp 99, 100 or 103, as desired. The variable dimmer means 45 or 45′ will also be used, room permitting, in the device 253. The knob 4 is shown in its rotating 13 and axially 14 moved dashed line position 20. The conventional small cup shaped housed, electric cord 259 and the small bulb-like photoelectric cell 261 are shown in dashed line outline, indicating the use thereof when the large cell 232 is not desired to be used. The open end of the cup 262 may be extended to reach a light source thus having one advantage. The conventional Edison screw base 255 and insulating material 257 is also shown. The improved large diameter washer 256 and its captive securing metal material 258 is also shown. A small conventional washer 256 may also be used in place of the large diameter washer 256. The slide switch is shown in its 235 "on" and half-on "dim" 235′ lamp 9, 100 or 103 sliding 14 positions.

FIG. 36 shows an "Electric Cord Feed-Thru Varistor Device" 55 secured to an electric-twin cord 133. A conventional slotted 263 screw 157 is shown in a counterbored hole 264 and having a threaded nut, not shown, on its other end, as is conventionally done with electric feed-thru wheel 35 and 35′ cord switches 56 and 57, shown in FIGS. 7 and 37. FIG. 36 further shows the cord 133 connected to an electric cord plug-in member 110 having two conventional electric plug-in prongs 219 and 220. The other end of the cord 133 is electrically connected, not shown, to an electrical device 238, for example, having at least one semiconductor device therein that will be protected by the device 55 against voltage transients. The cord 133 having two insulated twin members 15 and 15′ having electric conducting wires 43 and 44 therein, as shown in FIG. 7 for example. The varistor 54 which is housed in two half casings 131 and 132 is automatically electrically connected to and across the wires 43 and 44 by two separated pointed members (not shown) but are the same as the pointed members which are used in the feed-thru wheel 35 type of cord switch means 56 which is shown and used in FIG. 7 and 37. The varistor 54 is thereby automatically electrically connected to the wires 43 and 44, at the points 134 and 135 as is shown in FIG. 33, for example. Two small holes 265 having rivets 129 therein may also be used, if desired, as when the device 55 is riveted to the electrical devices or cord 133, when the equipment 238 is delivered.

The main purpose of the "Electric Cord Varistor Device" 55 shown in FIG. 36 is to save money by saving the electronic equipment from voltage transients, by providing a varistor 54 of, for example, the disclosed oxide diode type or the G.E. MOV., TYPE VP, into substantially the disclosed casing means 131 and 132 so that the varistor 54 may be piercingly electrically connected bridgingly across the two electrical conductors or wires 43 and 44. Electrical connection of the Electric Cord 'MOV' Varistor Device 55 is desired so as to have voltage transient protection means substantially for protecting at least one semiconductor component in an electrical device 228. Some of these components, for example, are capicotors; half-wave diodes; thyristors; SCR's; Triacs; transistors and the like. Dimming and non-dimming incandescent lamps; or basically, television sets; radios; electronic equipment; electronic computors and the like will also be protected against transient voltage spikes or in line surges by the device 55. A high voltage pulse or spike may be generated from external sources and even lighting.

FIG. 37 shows an electric cord half-wave incandescent lamp dimming device 56 when it has the subcombination means 48 thereon and 57 when it has the combination means 48′ therein, as is shown respectively in FIGS. 11 and 10, for example. In FIG. 37 the wheel or exposed half-wheel 35′ is rotatingly ratched 13 into two positions of "dim" and "on" for switch 56 and into 3-positions of an "off", "dim" and "on" for the switch 57. FIG. 37 shows the conventional hexagon opening 266 having a sloted 263 screw 157 therein with a threaded nut, not shown, on the end of screw 157. The conventional bulge 36′ provides room for the rotation of wheel 35′. The rest of FIG. 37 is self-explanatory through the FIG. 36 disclosure.

FIG. 38 shows a fragment of the large base 267 of lamp 9 or 103 having a conventional insulating material 257 and a solder or other metal electrical contacting portion 258. The single improvement in the lamp 9 or 103 is the large diameter metal washer 256 which is secured to the base 267 by the solder 258 or other conventional way. When the FIG. 38 single filament lamp 9 or 103 is inserted into a conventional 3-way lamp socket 108, the large diameter washer bridgingly also contacts the rigid electrical contacting and current passing prong 268 which extends transversely through the insulating disc member 269. Thereby both center electrical contacts 268 and 270 of the lamp socket 108 are electrically connected to the filament of lamps 9 or 103. Now, when the 3-way switch (not shown) of socket 108 is actuated from its "off" position, electric current will immediately pass through the prong 268 to the washer 256 and to the single filament, not shown, of the lamp 9 or 103. A second actuation passes current through the center contact 270 to the center metal contact 258 and again to the same filament. And, for the third actuation of the switch, electric current will pass through both contacts 268 and 270 again to the same filament. Thereby one "off" and three "on" positions are now made possible, rather than the aggrevating and annoying two "off" and two "on" which a conventional single filament lamp 9 or 103 would provide when it is intentionally inserted into a 3-way lamp socket, because of the expense of a 3-way lamp 100 or the lack of having one on hand. A person never has to now wonder, is there a bulb in the fixture? Is it totally creamed? Or when will the lamp go on, for example. The washer 256 may also have a concaved circular groove for contacting the top of the prong 268 or be dished upwardly more than that which is shown, accordingly as desired.

It has been found that the disclosed 120 degree, three-position switching means 34 of, for example, FIG. 10 may, as desired, be readily be converted to a 60° six-position electric cord wheel 35 type of switching means, which wheel 35 electric cord switching means 57 is shown in FIGS. 7 and 37 and designated as subcombination means 48'. It is now also obvious that the 120°, three-position switching means 34 will provide a person with twice the length of manual switching stroke, for each switching position, over that of the 60°, six-position, electric selective switching means (not shown) for each revolution of the wheel 35, for example. And especially when the three stationary electrical contacts shown in FIG. 10, are located 120° apart as shown. By using the FIG. 10 three stationary electrical contacts, which are spaced 120° apart, and the six-position rotating contacts, a person will be provided with an electrical "off"; half-wave "dim"; and "on"; then a second "off"; half-wave "dim" and "on" electrical switching position for each revolution of the wheel 35' which is shown in FIG. 37, for example.

However, the three-position switch 34 of FIG. 10 will thereby generally prevent an inadvertent "over-shooting" of at least one of its switching positions or by inadvertently over-shooting at least one switching position as a "machine-gunning" rapid electric switching action effect, especially if a person is nervous or in a hurry since the 60° stroke is only half the radial length of stroke of the 120° 34 switching means, of subcombination means 48' or 57 as shown in FIGS. 7, 10 and 37, for example.

The six-position switching means will, however, be used as desired or deemed necessary, in spite of the fact that with the use of the six-position switching means, a person can generally switch from the "off", overshoot the "dim" position to the "on" position or even to the "off" position, in one stroke of wheel 35, shown in FIG. 7 or wheel 35' shown in FIG. 37.

It must also be born in mind that thyristors such as SCR's or triacs, shown in FIG. 16, act basically as electrical gates or switches which must be opened and closed by a measuring unit, known in the art, whereas the very simple half-wave diode 52 of FIG. 10, for examle, does not depend on anything for performing its half-wave inherent function.

It should be noted that at least one of the various disclosed subcombinations being generally housed in at least one portion of at least one of the combination fixture devices, 1, 90 and the like, be it in an electrical cord switch casing; housing of an improved selective switch having no electrical "off" position; base portion; center body portion; upper neck-like portion; pole portion; lamp socket; and even in an improved lamp socket having a multiple selective switch with no electrical "off" position, as shown in FIG. 10, for example. The switch 34 and half-wave rectifier 52 subcombination means 48' having three-positions of an electrical "off"; "half-on"; and "on." The subcombination means 48' being substantially housed in a substantially conventional electric cord switch casing of the minature or even the non-minature type, for substantially controlling a "half-on" only a "half-on" or "on" only or even the "off", "half-on" and "on" only as well as any desired combination thereof, of at least one incandescent lamp, generally of the electrical cord type for ceiling and/or wall supporting suspended fixtures. The subcombinations 48 and 48' are to be used in floor; table; pole; bed; pin-up; swag-chain and the like incandescent lamp fixtures and also be used for controlling a string of Christmas tree lites (incandescent lamps) as well as outdoor ornamental or plain lites, accordingly. And also in electric cord adapters; switching pendant cord plugs; plug-in cord switch; cord plug-in plugs; conventional and non-conventional selectively switching and non-switching lamp sockets; electric clock, lamp and/or appliance, timers; photoelectric control devices and the like, most of which have at least one electric switching means 47 or 34 and the half-wave rectifier 52 subcombination means 48 or 48' substantially housed therein. For thereby, also saving money through saving of electricity, making bulbs or lamps last longer, less strain on one's eyes, safety features through cooler lamp temperature and the like.

The half-wave rectifying diode 52 being used alone, in series or parallel with another half-wave diode 52 to also be electrically housed, secured or clipped in place, and be electrically connected and housed or substantially housed inside of a buss fuse-type cartridge of the one time or replaceable type. The buss rectifying diode 52 type of cartridge, having end caps 127 and/or 214, as shon in FIGS. 27–29, being also inserted into a panel or in line or plugged in type of mounted buss fuse holder, as desired, for readily changing the "buss-rectifying-diode device" in the event of a malfunction, as is substantially executed for a buss fuse.

While the description of my particular invention is in reference to the particular embodiments shown, it is obvious that various modifications can be resorted to without departing from the spirit of the invention or the scope of the subjoined claims.

I claim:

1. An improved hung type of electric current incandescent lamp dimming combination fixture device, for electrical connection to a source of alternating electric current, comprising in combination:

a. an electric current incandescent lamp combination fixture having
   1. at least one portion of a first electrical conducting wire member and a second electrical conducting wire member electrically connected to at least one electrical circuit portion thereof;
   2. at least one alternating electric current incandescent lamp socket member having at least one receptacle portion having at least one first electrical contact member and a second electrical contact member therein;
   2. at least one subcombination means substantially housed in at least one portion of said fixture and consisting of a 2-position electric selectively switching means and at least one half-wave diode rectifying means being electrically connected between a first portion and a second portion of said first electrical conducting wire member which is also electrically connected substantially to said first electrical contact member;

b. said fixture having at least one portion of said first electrical conducting wire member and said second electrical conducting wire member housed in at least one portion thereof for electrical connection to said source of said electric current and for passing at least one electrical portion of said source of said electrical current through at least one portion of said first said conducting wire member and through at least one portion of said subcombination means and through at least one said contact member of said socket member and through at least one filament member enclosed in said lamp and substantially back through said second said contact member of said socket member and through said second conducting wire member to said source of said electric current when at least one electrical base portion of said lamp is removably inserted into said receptacle portion and when said source of said current is passed substantially to said switching means;

c. said switching means having a conventional manually operative means which is alternatingly manually operable at said fixture device into a half-wave diode rectified substantially half-on "dim" electrical switching position or into an "on" electrical switching position for selectively passing a half-wave rectified and a non-rectified full-wave portion of said source of said electric current to said filament member while at least an expensive 24-volt electrical relay switching means is otherwise saved when said subcombination means is electrically connected between said relay and said first said contact member of said socket member.

2. The combination of claim 1 wherein said rectifying means being at least one half-wave silicon diode rectifying means.

3. The combination of claim 1 wherein said subcombination means is housed substantially in a conventional electric cord switch casing means of the feed-thru electric cord type and said casing means is removably secured to one portion of an electric cord member of said fixture by at least one threaded screw and nut member.

4. The combination of claim 3 wherein said electric cord switch casing means having said manually operative means which is in the form of a partially exposed conventional rotating wheel member.

5. The combination of claim 3 wherein said manually operative means being a conventionally moved back and forth lever member.

6. The combination of claim 3 wherein said manually operative means being a conventionally sliding back and forth member.

7. The combination of claim 3 wherein said manually operative means being a conventional push-push member.

8. An improved hung type of electric current incandescent lamp dimming combination fixture device, for electrical connection to a source of alternating electric current, comprising in combination:

a. an electric current incandescent lamp combination fixture having 1. at least one portion of a first electrical conducting wire member and a second electrical conducting wire member electrically connected to at least one electrical circuit portion thereof;

2. at least one alternating electric current incandescent lamp socket member having at least one receptacle portion having at least one first electrical contact member and a second electrical contact member therein;

3. at least one subcombination means substantially housed in a conventional electric cord switch casing means of the feed-thru electric cord type; said subcombination means comprising of a 3-position electric selectively switching means and at least one half-wave diode rectifying means being electrically connected between a first portion and a second portion of said first electrical conducting wire member which is also electrically connected substantially to said first electrical contact member;

b. said fixture having at least one portion of said first electrical conducting wire member and said second electrical conducting wire member housed in at least one portion thereof for electrical connection to said source of said electric current and for passing at least one electrical portion of said source of said electrical current through at least one portion of said first said conducting wire member and through at least one portion of said subcombination means and through at least one said contact member of said socket member and through at least one filament member enclosed in said lamp and substantially back through said second said contact member of said socket member and through said second conducting wire member to said source of said electric current when at least one electrical base portion of said lamp is removably inserted into said receptacle portion and when said switching means is in an electrical current passing position;

c. said switching means having a conventional manually operative means which is manually operable at said fixture device into an electrical "off" switching position and into a half-wave diode rectified substantially half-on "dim" electrical switching position and into an electrical "on" switching position for selectively not passing said source of said electric current and for selectively passing a half-wave rectified and a non-rectified full-wave portion of said source of said electric current to said filament member while at least an expensive 24-volt electrical relay switching means is otherwise saved when said subcombination means is electrically connected between said relay and said first said contact member of said socket member.

9. The combination of claim 8 wherein said manually operative means being a conventional rotating wheel member.

10. The combination of claim 8 wherein said manually operative means being a conventional operatively moved back and forth lever member.

11. The combination of claim 1 wherein said subcombination means is substantially housed in at least one portion of at least one said socket member.

12. The combination of claim 11 wherein said subcombination means is housed substantially in base portion of at least one socket member; said base portion having a 2-position conventional electric selectively rotating switching means substantially housed therein for selectively switching said current "off" and "on" to at least one said filament member of at least one said lamp when a substantially rod-like member of said switching means is operatively manually rotated and when said rod-like member is operatively manually axially moved then said switching means of said subcombination means is actuated into its said "off" said switching position for providing said half-wave rectified portion of said current to at least one said filament member of at least one said lamp which thereby is in a "dim" illuminated state.

13. The combination of claim 12 wherein said 2-position said rotating switching means having two additional selectively switching positions and thereby being a conventional 3-way rotating 4-position electric selectively switching means for selectively switching said current to at least one of two separate filament members of at least one conventional 3-way said lamp and for providing at least 8 separate combinations of 3-illuminations from one conventional 3-way said lamp when said rod-like member of said switching means is also operatively manually axially moved for actuating said switching means of said subcombination means into its half-wave electrical current passing said half-on position and for shuntingly by-passing said rectifying means when said rod-like member is axially moved back to its original position and thereby passing an "on" full-wave of said current to at least one of two said filament members of at least one said 3-way said lamp.

14. The combination of claim 13 wherein said 3-way rotating, 4-position said switching means is of the "key" rotating type.

15. An improved hung type of electric current incandescent lamp dimming combination fixture device, for electrical connection to a source of alternating electric current, comprising in combination:

a. an electric current incandescent lamp combination fixture having
   1. at least one portion of a first electrical conducting wire member and a second electrical conducting wire member electrically connected to at least one electrical circuit portion thereof;
   2. at least one alternating electric current incandescent lamp socket member having at least one receptacle portion having at least one first electrical contact member and a second electrical contact member therein;
   3. at least one subcombination means substantially housed in at least one portion of said fixture and consisting of a 3-position electric selectively switching means and at least one half-wave diode rectifying means being electrically connected between a first portion and a second portion of said first electrical conducting wire member which is also electrically connected substantially to said first electrical contact member;

b. said fixture having at least one portion of said first electrical conducting wire member and said second electrical conducting wire member housed in at least one portion thereof for electrical connection to said source of said electric current and for passing at least one electrical portion of said source of said electrical current through at least one portion of said first said conducting wire member and through at least one portion of said subcombination means and through at least one said contact member of said socket member and through at least one filament member enclosed in said lamp and substantially back through said second said contact member of said socket member and through said second conducting wire member to said source of said electric current when at least one electrical base portion of said lamp is removably inserted into said receptacle portion and when said switching means is in an electrical passing position;

c. said switching means having a conventional manually operative means which switches said 3-position said switching means at said fixture device into an electrical "off", half-wave "dim" and full-wave "on" electrical state for selectively not passing said source of said electric current and for selectively passing a half-wave rectified and a non-rectified full-wave portion of said source of said electric current to said filament member while at least an expensive 24-volt electrical relay switching means is otherwise saved when said subcombination means is electrically connected between said relay and said first said contact member of said socket member

16. The subcombination of claim 15 wherein said subcombination having the 3-position said switching means is substantially housed in substantially a base portion of said socket member for providing at least one said lamp with said "off", half-wave "dim" and full-wave "on" electrical state.

17. The combination of claim 16 wherein said 3-position said switching means is operatively manually acutated into said "off", half-wave "dim" and full-wave "on" electrical state by manually pulling and releasing a conventional pull-chain member of said socket member.

18. The combination of claim 16 wherein said 3-position said switching means of said subcombination means is electrically connected serially with an improved rotary, three "on" position, 3-way electrical selectively switching means for selectively switching said current to a conventional 3-way said lamp for providing said 3-way said lamp with three "on" illuminations of "low", "medium" and "high" while said "off", said half-wave "dim" and an "on", not passing or passing respectively of electric current to said three "on" position said switching means is obtainable only when said operative manual means of said switching means is operatively manually axially moved; whereby preselection of any half-wave "low-dim", "medium-dim" or "high-dim", and any full-wave "low", "medium" or "high" electrical illuminations of a conventional said 3-way said lamp is now possible before any said source of said electric current is passed to any filament member of said conventional said 3-way said lamp.

19. The combination of claim 18 wherein said rotary three "on" position said switching means and said subcombination means are serially electrically connected and are substantially housed within a base portion a 3-way said socket member.

20. The combination of claim 18 wherein a conventional 2-position "off and on" electric selectively switching means is mounted substantially to at least one portion of said three "on" position said switching means for alternatingly not passing or passing a full-wave "on" of said source of said electric current to said three "on" position said switching means when said operative manual means of said rotary three "on" position said switching means is manually axially moved; whereby preselection of any said low, medium or high electrical position of said three "on" position said switching means is made possible and yet any of said "low","medium" or "high" illuminations of said lamp is operatively manually switched "off" without changing any of the preselected "low," "medium", or "high" rotary positions.

21. The combination of claim 20 wherein said rotary three "on" position said switching means and said 2-position "off" and "on" said switching means are serially electrically connected and are substantially housed withing a base portion of a 3-way said socket member.

* * * * *